US009110418B2

(12) United States Patent
Kabata et al.

(10) Patent No.: US 9,110,418 B2
(45) Date of Patent: Aug. 18, 2015

(54) COLOR IMAGE FORMING METHOD AND COLOR IMAGE FORMING APPARATUS

(71) Applicants: Toshiyuki Kabata, Kanagawa (JP); Momoko Shionoiri, Kanagawa (JP); Masato Iio, Kanagawa (JP); Tsuyoshi Asami, Kanagawa (JP)

(72) Inventors: Toshiyuki Kabata, Kanagawa (JP); Momoko Shionoiri, Kanagawa (JP); Masato Iio, Kanagawa (JP); Tsuyoshi Asami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 47 days.

(21) Appl. No.: 13/945,527

(22) Filed: Jul. 18, 2013

(65) Prior Publication Data

US 2014/0023967 A1 Jan. 23, 2014

(30) Foreign Application Priority Data

Jul. 20, 2012 (JP) ..... 2012-161735

(51) Int. Cl.

| | |
|---|---|
| ***G03G 13/20*** | (2006.01) |
| ***G03G 8/00*** | (2006.01) |
| ***G03G 13/22*** | (2006.01) |
| ***G03G 15/00*** | (2006.01) |

(52) U.S. Cl.

CPC ..... *G03G 13/22* (2013.01); *G03G 15/6582* (2013.01)

(58) Field of Classification Search

CPC ..... G03G 13/22; G03G 15/6582
USPC ..... 430/124.13, 107.1; 399/341, 342
See application file for complete search history.

(56) References Cited

U.S. PATENT DOCUMENTS

2007/0238813 A1 10/2007 Anderson et al.
2012/0243890 A1 * 9/2012 Iio et al. ..... 399/39

FOREIGN PATENT DOCUMENTS

| | | |
|---|---|---|
| JP | 2522333 | 5/1996 |
| JP | 10-309876 | 11/1998 |
| JP | 2007-277547 | 10/2007 |
| JP | 2012-078565 | 4/2012 |
| JP | 2012-181314 | 9/2012 |
| JP | 2012-181315 | 9/2012 |
| JP | 2012-198468 | 10/2012 |
| JP | 2012-242726 | 12/2012 |

* cited by examiner

*Primary Examiner* — Thorl Chea
(74) *Attorney, Agent, or Firm* — Cooper & Dunham LLP

(57) ABSTRACT

A color image forming method, including: forming electrostatic latent image on electrostatic latent image bearing member; developing the image to form visible image with at least two toners containing releasing agent and selected from black, magenta, cyan and yellow toners; transferring the visible image to recording medium; fixing the transferred image thereon with fixing member having no releasing agent on surface thereof; and forming overcoat layer on the fixed image by polymerizing overcoat composition, wherein when lightness—L1, chromaticity—a1 and chromaticity—b1 according to L*a*b* color system of the fixed image formed with the at least two toners and lightness—L2, chromaticity—a2 and chromaticity-b2 of the fixed image after the overcoat composition is dropped at 0.4 mg/cm$^2$ from height of 10 mm above the fixed image and the overcoat composition is removed after 10 seconds have passed are applied to the following formula (1), color difference ΔE* is 3.0 to 30.0:

$$\Delta E^*=[(a2-a1)^2+(b2-b1)^2+(L2-L1)^2]^{1/2} \quad (1).$$

8 Claims, 6 Drawing Sheets

COLOR IMAGE FORMING METHOD AND COLOR IMAGE FORMING APPARATUS

BACKGROUND OF THE INVENTION

1. Field of the Invention

The present invention relates to a color image forming method and a color image forming apparatus.

2. Description of the Related Art

For the purpose of imparting a high-grade sense to an image and increasing the durability thereof, an overcoat layer of varnish or the like has been conventionally provided on the surface of the image that appears on color pages, etc., of tickets, catalogues and magazines. Particularly, in commercial fields, varnish layers are formed on images printed in a great number by screen printing, etc. Although these images are in general high in percentage of image area, they can be prepared as beautiful images having a high-grade sense due to good compatibility of varnish with ink used in screen printing.

However, in recent years, there has been found an increasing demand for frequently changing and updating information to be printed. Therefore, a printing method such as screen printing which prepares an original text for printing is not economically feasible in many cases and so-called print on-demand has started to be used.

A recording method used in the above-described print on-demand usually includes an electrophotographic method and an inkjet method. The inkjet method is suitable for a small quantity of printed matter but unable to cope with a case that images are formed quickly and in a great quantity due to the long drying time of ink. Further, ink which has permeated into a recording medium such as paper will cause expansion or contraction of the paper to result in a slight change in thickness of the paper depending on a site of an image. It is, therefore, difficult to stack in an orderly manner a large quantity of ink recorded matter on which images are formed. As a result, the electrophotographic method using toner currently prevails. In the electrophotographic method, image information is exposed on a charged photoconductor to form a latent image, toner is used to develop the latent image, the thus obtained toner image is transferred to a recording medium such as paper and, thereafter, the transferred image is thermally fixed on the paper.

As a technology on the overcoat layer used in the electrophotographic method, there has been proposed, for example, an overcoat composition which is based on water, free of ammonia and low in static surface tension as an overcoat composition used for a to-be-printed matter on which fixing oil is coated (refer to Japanese Patent Application Laid-Open (JP-A) No. 2007-277547).

There have been also proposed a resin forming device which forms a silicone resin layer on a printing surface to protect the printing surface, giving waterproofing and imparting gloss, and an image forming apparatus which is provided with the resin forming device (refer to Japanese Patent Application Laid-Open (JP-A) No. 10-309876).

Further, there has been proposed a method for printing metal containers in which an electrophotographic method is used to efficiently print various types of printed matter in a small lot and a finish varnish layer is provided to protect a toner layer and impart gloss (refer to Japanese Patent (JP-B) No. 2522333).

The methods proposed above are all preferable in providing an overcoat layer on an electrophotographically formed image.

For an improvement in mold releasability, silicone oil has been coated in a great quantity on the surface of a fixing roller of a fixing unit used in an electrophotographic method. However, toner is greatly different in mold releasability between a site which has silicone oil on the fixing roller and a site which is free of silicone oil. Therefore, a site on which silicone oil is not coated will cause streaks which are different in gloss. Large-scale printing could increase costs accordingly, if the printing should fail. Further, where silicone oil adheres on a floor, the floor becomes quite slippery. Still further, since complete removal of silicone oil is difficult, full attention is required in supplementing the silicone oil and maintaining the fixing unit. And, this is troublesome for those involved in maintenance work.

In recent years, so-called oilless fixing has been carried out in which wax-containing toner is used to heat a toner image on fixing, allowing the wax contained in the toner to ooze out on the surface of the image, thereby securing mold releasability of the image from a fixing roller. In the oilless fixing, where wax is present in a greater quantity between the image on fixing and the fixing roller, the mold releasability of the image from the fixing roller is further improved. For this reason, wax is added to toner to the extent possible, and such wax that easily melts at a low temperature is used to appropriately adjust fixing conditions (pressure of the fixing roller, fixing temperature and fixing time) which facilitates melting of the wax.

However, in an attempt to provide an overcoat layer on an image on which the above-described oilless fixing has been carried out, wax on a fixed image repels an overcoat composition. Thus, there are problems that the overcoat layer becomes quite thin in thickness at a site great in image area, the cured overcoat layer is not firmly attached on an oilless fixed image and scratching or bending of the surface results in detachment of the overcoat layer.

Further, a color image is formed by overlapping respective yellow, magenta, cyan and black color toners on a recording medium. Therefore, the color image is greater in quantity of toner adhered than a single-color black-and-white image and also greater in content of wax. As a result, the color image is further decreased in attachment property of the overcoat layer than the black-and-white image, which makes the above problems more apparent.

SUMMARY OF THE INVENTION

An object of the present invention is to provide a color image forming method by which it is possible to form a high-grade and beautiful image great in durability even in formation of a color image that is greater in content of a releasing agent than a black-and-white image and also lower in attachment property to an overcoat layer.

A color image forming method of the present invention for solving the above-described problems includes: an electrostatic latent image forming step which forms an electrostatic latent image on an electrostatic latent image bearing member; a development step which develops the electrostatic latent image to form a visible image with at least two toners each containing a releasing agent and being selected from black toner, magenta toner, cyan toner and yellow toner; a transfer step which transfers the visible image to a recording medium; a fixing step which fixes a transferred image on the recording medium with a fixing member having no releasing agent on a surface thereof, and an overcoat layer forming step which forms an overcoat layer on the fixed image by polymerizing an overcoat composition, wherein when lightness L1, chromaticity a1 and chromaticity b1 according to an L*a*b* color system of the fixed image formed with the at least two toners as well as lightness L2, chromaticity a2 and chromaticity b2 according to the L*a*b* color system of the fixed image obtained after the overcoat composition is dropped at 0.4 mg/cm$^2$ from a height of 10 mm above the fixed image and the overcoat composition is removed after 10 seconds have passed are applied to the following formula (1), a color difference ΔE* is from 3.0 to 30.0:

$$\Delta E^*=[(a2-a1)^2+(b2-b1)^2+(L2-L1)^2]^{1/2} \quad (1).$$

According to the present invention, it is possible to provide a color image forming method which is capable of solving the above-described various conventional problems, attaining the above object and also forming a high-grade beautiful image great in durability even in formation of a color image greater in content of a releasing agent than a black-and-white image and lower in attachment property to an overcoat layer.

Figure 1A:
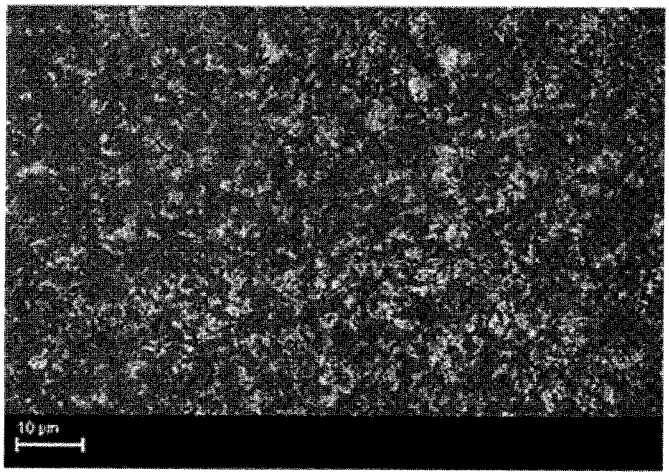
FIG. 1A is a reflection electron image of an oilless fixed image which is poorly bonded with a chemically modified overcoat layer.

DETAILED DESCRIPTION OF THE INVENTION (Color Image Forming Method and Color Image Forming Apparatus)

A color image forming method of the present invention includes an electrostatic latent image forming step, a development step, a transfer step, a fixing step, and an overcoat layer forming step and further includes other steps, whenever necessary.

A color image forming apparatus of the present invention includes an electrostatic latent image bearing member, an electrostatic latent image forming unit, a development unit, a transfer unit, a fixing unit, and an overcoat layer forming unit and further includes other units, whenever necessary.

The color image forming method of the present invention can be carried out favorably by the color image forming apparatus of the present invention, the electrostatic latent image forming step can be carried out by the electrostatic latent image forming unit, the development step can be carried out by the development unit, the transfer step can be carried out by the transfer unit, the fixing step can be carried out by the fixing unit, the overcoat layer forming step can be carried out by the overcoat layer forming unit, and the other steps can be carried out by the other units.

An overcoat layer formed by being cured by light or electron beam radiation on an oilless fixed image which has been subjected to oilless fixing is in general favorably attached to toner starting particles which contain a binding resin such as polyester and polystyrene. However, since the oilless fixed image contains a releasing agent (wax), the toner starting particles are required to be attached more firmly to the overcoat layer. The toner starting particles are more firmly attached to the overcoat layer with an increase in affinity between the toner starting particles and the overcoat composition. Therefore, the overcoat composition used in the present invention is preferably that which dissolves or swells the toner starting particles.

In the present invention, when lightness L1, chromaticity a1 and chromaticity b1 according to the L*a*b* color system of the fixed image formed with at least two toners as well as lightness L2, chromaticity a2 and chromaticity b2 according to the L*a*b* color system of the fixed image obtained after the overcoat composition is dropped at 0.4 mg/cm$^2$ from a height of 10 mm above the fixed image and the overcoat composition is removed after 10 seconds have passed are applied to the following formula (1), a color difference ΔE* is from 3.0 to 30.0, preferably from 4.0 to 20.0 and more preferably from 4.0 to 10.0:

$$\Delta E^*=[(a2-a1)^2+(b2-b1)^2+(L2-L1)^2]^{1/2} \quad (1).$$

Where the color difference ΔE* is less than 3.0, the overcoat layer may be inferior in attachment property. Where the color difference ΔE* is in excess of 30.0, there is a case that the overcoat composition may allow a fixed image to dissolve, thereby disturbing the image. The color difference which is in the above-described preferable range is advantageous in providing better attachment property. That is, where the overcoat composition is in a range at which the toner starting particles can melt appropriately, the image is not disturbed and the overcoat layer is excellent in attachment property.

More specifically, it is possible to determine the color difference ΔE* by the following procedure.

The color image forming apparatus is used to form a red-color fixed solid image by overlapping two color toners, that is, magenta toner and yellow toner, on an OHP (overhead projector) sheet as a recording medium. The OHP sheet on which the red-color fixed solid image has been formed is sandwiched with another OHP sheet and a spectroscopic densitometer (X-Rite 938 made by X-Rite Inc.) is used to measure lightness L1, chromaticity a1 and chromaticity b1 of the fixed image according to the L*a*b* color system (before titration). It is noted that the OHP sheet is sandwiched as described above to keep the spectroscopic densitometer (X-Rite 938 made by X-Rite Inc.) clean.

Figure 7:
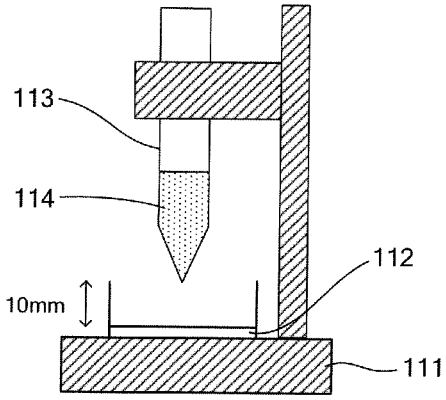
FIG. 7 is a schematic diagram which shows a device used in a fusion property test.

Next, a fusion tester shown in FIG. 7 is used to put an overcoat composition 114 into a dropping burette 113 and the overcoat composition is set so as to be 10 mm in height above the red-color fixed solid image formed on an OHP sheet 112 placed on a titration base 111. Next, the overcoat composition 114 is dropped at a quantity of 0.4 mg and a microwipe MU-2000 (made by MCC Co., Ltd.) is used to remove the overcoat composition 114 after 10 seconds have passed. The OHP sheet on which the red-color fixed solid image has been formed is sandwiched with another OHP sheet and the spectroscopic densitometer (X-Rite 938 made by X-Rite Inc.) is used to determine lightness L2, chromaticity a2 and chromaticity b2 of the fixed image according to the L*a*b* color system (after titration). These measured values are applied to the following formula (1), thus making it possible to calculate a color difference ΔE* before and after titration of the overcoat composition.

$$\Delta E^*=[(a2-a1)^2+(b2-b1)^2+(L2-L1)^2]^{1/2} \quad (1)$$

Further, the inventors have studied in detail a phenomenon in which the overcoat composition is repelled on the oilless fixed image and have found that spots liable to repel the overcoat composition are not present uniformly but a solid image part where an image is present and also great in image area is liable to repel the overcoat composition. Thus, an electron microscope is used to observe a cross section of the solid image part which has been subjected to oilless fixing, thereby revealing that a releasing agent (wax) of toner covers the surface of the image substantially in its entirety.

It has been also found that a spot which has an overcoat layer on an oilless fixed image and is liable to detachment of the overcoat layer is a spot which has an image, and solid image parts great in quantity of toner adhered (in particular, red, blue and green spots) are liable to detachment most easily. Therefore, observations by using an electron microscope have been carried out for a boundary surface between a solid image part having an overcoat layer at a solid image part of the image which has been subjected to oilless fixing and the overcoat layer. It has been revealed that there is a spot having wax on the boundary surface between the solid image part and the overcoat layer, and in a spot having the wax, such a spot is present that the overcoat layer is slightly afloat. That is, it has been found that the larger the number of spots at which the wax is in contact with the overcoat layer, the greater the attachment property of the overcoat layer to the oilless fixed image is decreased.

Wax involved in the attachment property of the oilless fixed image to the overcoat layer is distributed on the outermost surface of the oilless fixed image, and wax present inside the image is not involved. Therefore, evaluation has been made for whether the oilless fixed image on which the overcoat layer is favorably provided can be regulated or not with reference to a distribution state of the wax on the outermost surface of the oilless fixed image.

Here, as techniques for observing an inner structure of a polymer, when observations are carried out by using a transmission electron microscope (TEM), a section of a polymer is treated with osmium tetroxide (K. Kato: Polym. Eng. Sci., 7, 38), ruthenium tetroxide (J. S Trent et al.: Macromolecules, 16, 589), tungstophosphoric acid (K. Hess et al.: Kalloid-Z, 168, 37), etc.

Chemical modification is effected in a different manner depending on each polymer and a substance which effects chemical modification contains a heavy metal. Since electrons are less likely to transmit, a chemically modified polymer is observed darkly, while a polymer which is not chemically modified is observed brightly. The above-described substances are generally used in techniques for imparting contrast to a TEM image. Of the substances, ruthenium tetroxide can be applied to many polymer materials, and is therefore preferable.

Evaluation has been made for whether a site having wax can be distinguished from a site free of wax in an image (SEM image) taken by a scanning electron microscope when an oilless fixed image is chemically modified by ruthenium tetroxide, with attention given to the fact that toner starting particles containing a binding resin such as polyester and polystyrene are easily chemically modified by ruthenium tetroxide and the wax is by far less likely to be chemically modified by ruthenium tetroxide than the toner starting particles. That is, Ru which is a structural element of ruthenium tetroxide is much larger in atomic number than hydrogen, carbon, nitrogen and oxygen which are structural elements of the oilless fixed image. Therefore, in the SEM image, such characteristics can be utilized that reflection electrons or secondary electrons from a sample are increased in quantities with an increase in the atomic number of elements.

Further, since ruthenium tetroxide modifies only the outermost surface of the sample, it is necessary that a depth region to be observed by a scanning electron microscope (SEM) is the outermost surface to the extent possible.

It is generally known that on SEM observations, the depth of a sample to be observed depends on accelerating voltage. When accelerating voltage is applied at 1 kV or less, it is possible to observe only information on the depth of dozens of nm or less.

On the basis of the above-described findings, after the oilless fixed image is treated with vapor of ruthenium tetroxide, reflection electrons are used to observe the surface of the fixed image, with the accelerating voltage of the SEM kept at 0.8 kV. It has been found that a part having wax is dark, while a part free of wax is bright in observation.

It has been also found that an area percentage of the dark part of the SEM image (reflection electron image) can be handled as a coverage factor of wax on the outermost surface of the oilless fixed image, and the coverage factor of wax on the outermost surface of the oilless fixed image can be referenced to regulate an oilless fixed image on which an overcoat layer can be favorably provided.

Therefore, in the present invention, when at least any one of red, green and blue fixed solid images formed with at least two toners using a test chart No. 4 according to ISO/IEC 15775:1999 is exposed to saturated vapor of an aqueous ruthenium tetroxide solution and is then radiated with electron beams at accelerating voltage of 0.8 kV to obtain a reflection electron image and the reflection electron image is converted to a binarization image formed of a black part and a white part, an area percentage of the black part with respect to an entire area of the binarization image (sometimes referred to as "wax coverage factor") is preferably from 40% to 70% and more preferably from 42% to 65%. Where the wax coverage factor is less than 40%, there is a case that the mold releasability of an image from a fixing roller may be decreased to result in a failure of obtaining a high quality image. Where the wax coverage factor is in excess of 70%, there is a case that the overcoat layer may be decreased in attachment property.

It is noted that where an image forming apparatus for a color image is used to form a black-and-white image, the black-and-white image is from 30% to 60% in wax coverage factor.

-Chemical Modification-

In a method for determining the wax coverage factor, there is no particular restriction on the concentration of ruthenium tetroxide on exposure of the surface of the oilless fixed image to saturated vapor of an aqueous ruthenium tetroxide solution, as long as ruthenium tetroxide can be chemically modified safely and at a high reproducibility. For example, 5% by mass of an aqueous ruthenium tetroxide solution which is commercially available as an electron microscope reagent (made by TABB Inc. (England)) is used to chemically modify ruthenium tetroxide stably, and is therefore preferable.

When the aqueous ruthenium tetroxide solution is kept in a sealed space, ruthenium tetroxide will volatilize into saturated vapor. Therefore, an oilless fixed image is placed in the sealed space, thus making it possible to chemically modify the oilless fixed image easily with ruthenium tetroxide.

Here, the saturated vapor of the aqueous ruthenium tetroxide solution may be exposed at a room temperature. For example, temperatures of 15° C. to 35° C. are preferable and 18° C. to 30° C. are more preferable.

There is no particular restriction on the exposure time to the ma saturated vapor of the aqueous ruthenium tetroxide solution, as long as the oilless fixed image is chemically modified reliably and can be clearly separated from a releasing agent on SEM observations. The exposure time is preferably from 3 minutes to 8 minutes and more preferably from 4 minutes to 6 minutes.

Where the exposure time is less than 3 minutes, there is a case that the oilless fixed image may not be chemically modified sufficiently and the fixed image may not be clearly separated from the releasing agent, which is not preferable. On the other hand, where the exposure time is in excess of 8 minutes, ruthenium tetroxide adheres on the surface of the releasing agent as well. And, there is a case that a dark part observed in a SEM image may be increased in percentage or a boundary between a spot having a releasing agent and a spot free of the releasing agent may not be clearly distinguished.

-SEM Observations-

When a scanning electron microscope (SEM) is used to observe the surface of an oilless fixed image treated with ruthenium tetroxide, it is found that a part having wax is dark and a part free of wax is bright in observation. At this time, accelerating voltage is preferably from 0.3 kV to 1.0 kV and more preferably from 0.5 kV to 0.9 kV.

Where the accelerating voltage is in excess of 1.0 kV, information is detected from a site at which the oilless fixed image is deep. Therefore, when wax adheres thinly, information is collected from the surface of the oilless fixed image chemically modified by ruthenium tetroxide through the wax. In the present invention, the accelerating voltage is applied at 0.8 kV, thus making it possible to observe a region of the outermost surface on which the wax is present at a high reproducibility.

Where SEM observations are carried out for the oilless fixed image which has been treated with ruthenium tetroxide, it is found that a site having wax is dark and a site free of wax is bright in observation both in a secondary electron image and a reflection electron image. Thus, the site having wax can be distinguished from the site free of wax more clearly in the reflection electron image.

This is due to the fact that the reflection electrons and the secondary electrons are increased in quantity with an increase in the atomic number of elements. The reflection electrons are produced in a greater quantity than the secondary electrons, depending on an increase in the atomic number. As a result, in the reflection electron image, a site having wax is darker and a site free of wax is brighter to such an extent that can eliminate irregularity information kept by the oilless fixed image, and this is preferable.

Figure 2A:
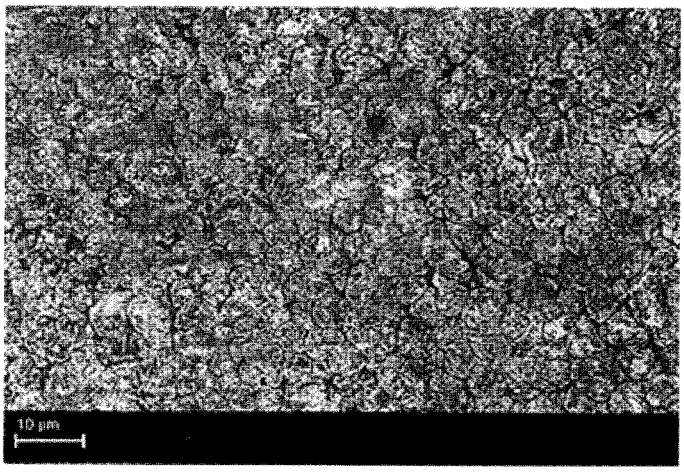
FIG. 2A is a reflection electron image of an oilless fixed image which is favorably bonded with a chemically modified overcoat layer.

In this case, FIG. 1A shows an oilless fixed image which is poorly attached to an overcoat layer. FIG. 2A shows an oilless fixed image which is favorably attached to an overcoat layer.

As shown in a reflection electron image obtained by chemically modifying an oilless fixed image with ruthenium tetroxide to carry out, thereafter, SEM observations of the oilless fixed image at accelerating voltage of 0.8 kV, it is apparent that the poorly attached oilless fixed image in FIG. 1A is dark in its entirety and quite small in the number of bright spots. Meanwhile, it is apparent that the favorably attached oilless fixed image in FIG. 2A is bright in its entirety and small in the number of dark spots.

The reflection electron image is observed at any magnification appropriately selected depending on how wax is present. There is no particular restriction on the magnification, as long as observations are carried out for a region having toner. The magnification is preferably from ×100 to ×2,000.

-Binarization Processing-

Figure 1B:
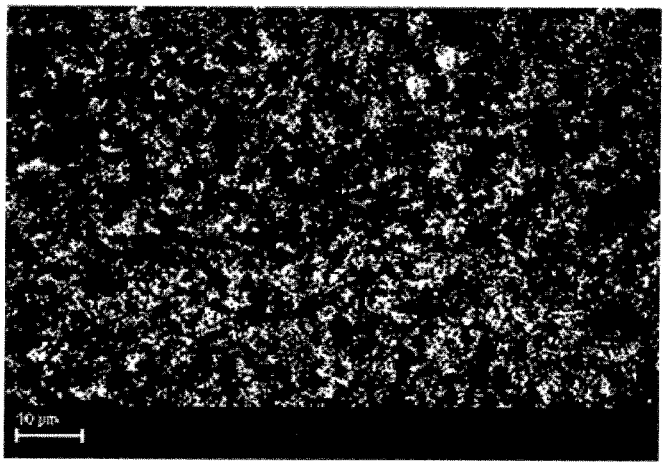
FIG. 1B is a binarization image of the image given in FIG. 1A.
Figure 2B:
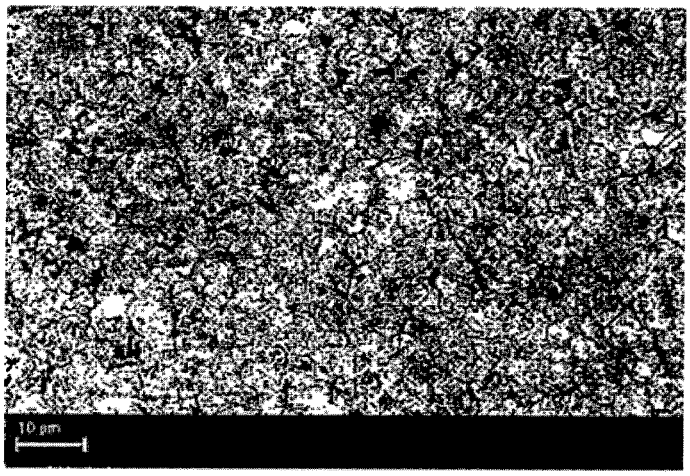
FIG. 2B is a binarization image of the image given in FIG. 2A.

There is carried out image processing (binarization) in which individual pixels (or a predetermined number of pixel units) which configure an obtained reflection electron image (image data) are classified into a part that looks black (black part) and a part that looks white (white part) to obtain a binarization image. FIG. 1B shows a binarization image of FIG. 1A. FIG. 2B shows a binarization image of FIG. 2A.

In effecting binarization, it is acceptable that brightness is determined, for example, for each pixel and where the brightness is at a certain value (threshold value) or more, the white part is given and where the brightness is less than a certain value, the black part is given. Further, the threshold value is set with reference to a histogram of brightness.

-Calculation of Area Percentage of Black Part-

Next, calculation is made for an area percentage of a black part with respect to an entire binarization image on the basis of a reflection electron image. It is acceptable that the calculation is made, for example, by arithmetic processing in which an entire area of the binarization image and an area of the black part are determined to divide the area of the black part by the entire area of the binarization image or the calculation is made by arithmetic processing in which the number of pixels (number of dots) of the black part is divided by the number of pixels of the entire binarization image.

Here, in the reflection electron image, a region having wax looks black, while a region free of wax looks white. It can be, therefore, thought that the area percentage of the black part with respect to the entire binarization image is a wax coverage factor.

In the oilless fixed image, it is preferable to regulate the wax coverage factor of a spot which is greatest in toner adhesion quantity.

In the image forming method of the present invention which uses an oilless fixing method, an exclusive source of wax which deteriorates the attachment property of an oilless fixed image to an overcoat layer is toner. Therefore, in the oilless fixed image, a site which is greatest in wax content is a spot at which the toner adheres in a great quantity, that is, a solid part of the image.

In formation of an electrophotographic image, four different color toners of black, magenta, cyan and yellow are used to reproduce various colors. Therefore, in a solid image of the oilless fixed image, red, blue and green spots are those where the toners adhere in a greater quantity than a black spot and also greater in content of wax.

In the present invention, at least any one of red, green and blue fixed solid images formed with at least two toners using a test chart No. 4 according to ISO/IEC 15775:1999 is exposed to saturated vapor of an aqueous ruthenium tetroxide solution and is then radiated with electron beams at accelerating voltage of 0.8 kV to obtain a reflection electron image and the reflection electron image is converted to a binarization image formed of a black part and a white part. Where an area percentage of the black part with respect to an entire area of the binarization image ("wax coverage factor") is from 40% to 70%, the attachment property to the overcoat layer is favorable and a high-grade beautiful image is obtained.

The wax coverage factor will vary in accordance with the content of wax in toner, a distribution state and types of wax. The lower the content of wax in the toner, the lower the wax coverage factor becomes. The greater the wax in the toner is available in the vicinity of the surface of the toner, the higher the wax coverage factor becomes. Further, an oilless fixed image is further increased in wax coverage factor as there is used wax which is lower in melting point and higher in flowability.

The wax coverage factor of the oilless fixed image will also vary in accordance with an adhesion quantity of toner. The lower the adhesion quantity of the toner, the lower the wax coverage factor becomes. In an image on which an overcoat layer is provided, the surface of the image becomes flat. Therefore, the image is taken as being denser than usual, and the adhesion quantity of the toner can be decreased to lower the wax coverage factor.

Further, the wax coverage factor of the oilless fixed image also varies depending on fixing conditions. As a matter of course, the higher the fixing temperature, the longer the image is heated by a fixing roller and the higher the pressure of the fixing roller is, the higher the wax coverage factor of the oilless fixed image becomes.

As described so far, many factors are found by which the wax coverage factor of the oilless fixed image varies. However, the wax coverage factor of the oilless fixed image can be easily set at a substantially constant value, if individual conditions are defined. Therefore, a high-grade and beautiful image great in durability can be obtained by providing an overcoat layer on the image.

<Electrostatic Latent Image Forming Step and Electrostatic Latent Image Forming Unit>

The electrostatic latent image forming step is a step of forming an electrostatic latent image on an electrostatic latent image bearing member and carried out by an electrostatic latent image forming unit.

The electrostatic latent image bearing member (which may be hereinafter referred to as "electrophotographic photoconductor," "photoconductor" or "image carrying body") is not particularly restricted in terms of the material, shape, structure, size, or the like thereof and any of the mentioned can be appropriately selected from those known in the art. The electrostatic latent image bearing member preferably has a drum-like shape, and the examples of the material thereof include, for example, inorganic photoconductors such as amorphous silicone, selenium and organic photoconductors (OPC) such as polysilane and phthalopolymethin. Of these materials, amorphous silicone and the like are preferable in terms of an extended service life.

The electrostatic latent image can be formed, for example, by uniformly charging the surface of the electrostatic latent image bearing member and then exposing imagewise by means of the electrostatic latent image forming unit.

The electrostatic latent image forming unit is provided at least with, for example, an electrification device for uniformly charging the surface of the electrostatic latent image bearing member and an exposure device for exposing imagewise the surface of the electrostatic latent image bearing member.

The charging can be performed by applying electric voltage to the surface of the electrostatic latent image bearing member by using, for example, the electrification device.

There is no particular restriction on the electrification device and any electrification device can be appropriately selected depending on the purpose. The electrification device includes, for example, contact-type electrification devices known in the art and equipped with a conductive or semi-conductive roller, a brush, a film, a rubber blade or the like, and non-contact type electrification devices which utilize corona discharge such as corotron and scorotron.

Further, it is preferable that the electrification device is that arranged in the electrostatic latent image bearing member in a contact or non-contact state and charges the surface of the electrostatic latent image bearing member by superimposing and applying a direct current voltage and an alternating current voltage.

Still further, it is preferable that the electrification device is a charging roller which is arranged in the electrostatic latent image bearing member in close proximity so as not to be in contact via a gap tape and the surface of the electrostatic latent image bearing member is charged by superimposing and applying a direct current voltage and an alternating current voltage to the charging roller.

The exposure can be performed by exposing imagewise the surface of the electrostatic latent image bearing member by using, for example, the exposure device.

There is no particular restriction on the exposure device and any exposure device can be appropriately selected depending on the purpose, as long as exposure can be conducted imagewise according to an image to be formed on the surface of the electrostatic latent image bearing member charged by the electrification device. For example, various types of exposure devices are included such as a photocopy optical system, a rod lens array system, a laser beam optical system, and a liquid crystal shutter optical system.

In the present invention, a back exposure system may be employed in which exposure is conducted imagewise from the backside of the electrostatic latent image bearing member.

<Development Step and Development Unit>

The development step is a step of developing the electrostatic latent image using at least two toners which contain a releasing agent and are selected from black toner, magenta toner, cyan toner and yellow toner to form a visible image and can be carried out by using a development unit.

There is no particular restriction on the development unit as long as an image can be developed by using, for example, at least two toners selected from the black toner, the magenta toner, the cyan toner and the yellow toner and developers of the respective colors. Any developing unit can be appropriately selected from conventionally known units. For example, a developing unit which is at least provided with a developing device which houses the toners and developers of the respective colors and which is capable of imparting the developers to the electrostatic latent image in a contact or non-contact manner is cited.

The developing device may be a dry-type developing device, a wet-type developing device, a single color developing device or a multi-color developing device. For example, a developing device which has an agitator for frictionally agitating the developers to effect charging and a rotatable magnet roller is cited.

Inside the developing device, for example, the toners of the respective colors and carriers are mixed and agitated, and the toners are charged by the resulting friction and kept raised on the surface of a rotating magnet roller, thereby forming a magnetic brush. Since the magnet roller is arranged in the vicinity of the electrostatic latent image bearing member, the toners configuring the magnetic brush formed on the surface of the magnet roller are partially moved to the surface of the electrostatic latent image bearing member due to an electrical suction force. As a result, the electrostatic latent image is developed with the toners and a visible image is formed on the surface of the electrostatic latent image bearing member with the toners.

<<Toners>>

The above-described toners include at least two toners selected from black toner, magenta toner, cyan toner and yellow toner.

Each of the respective color toners contains at least a releasing agent, preferably contains a binding resin and a coloring agent, and also contains other components, whenever necessary.

-Releasing Agent-

There is no particular restriction on the releasing agent and any releasing agent can be appropriately selected depending on the purpose. Preferable are waxes.

The waxes include, for example, natural waxes, synthesized waxes and other waxes.

The natural waxes include, for example, vegetable-based waxes such as carnauba wax, cotton wax, haze wax, rice wax, animal-based waxes such as bee wax and lanolin, mineral-based waxes such as ozokerite and selsyn, and petroleum-based waxes such as paraffin wax, microcrystalline wax and petrolatum wax.

The synthesized waxes include, for example, synthesized so hydrocarbon waxes such as Fischer Tropsch wax, polyethylene and polypropylene, fat-based synthesized waxes such as ester, ketone and ether, and hydrogenated waxes.

Other waxes include, for example, fatty acid amide compounds such as 12-hydroxy stearamide, stearamide, anhydrous phthalic acid imide and chlorinated hydrocarbon; homopolymers or copolymers of polyacrylate such as poly-n-stearyl methacrylate, poly-n-lauryl methacrylate which are crystalline high-polymer resins with low molecular weight (copolymers of, for example, n-stearyl acrylate-ethyl methacrylate or the like) and crystalline high-polymer resins having a long alkyl group on a side chain.

Of these waxes, preferable are paraffin wax, microcrystalline wax, Fischer Tropsch wax, polyethylene wax and polypropylene wax. In particular, preferable is microcrystalline wax in terms of mold releasability.

The microcrystalline wax contains isoparaffin and cycloparaffin and crystallizes in a relatively small size. Therefore, the wax is not uniformly present on an oilless fixed image but more likely to be present in a state of dispersion. As a result, the oilless fixed image can be decreased in wax coverage factor.

It is preferable in view of attachment property to an overcoat composition that the above-described wax contains isoparaffin which is a hydrocarbon component in 10% by mass or more.

There is no particular restriction on the weight-average molecular weight of the wax and any weight-average molecular weight can be appropriately selected depending on the purpose. The weight-average molecular weight is preferably 500 or more in view of attachment property to the overcoat composition.

Here, isoparaffin content of the wax (% by mass) and weight-average molecular weight of the wax can be determined by using a gas chromatograph TOF-type mass spectrometer, for example, JMS-T100GC "AccuTOF GC" (made by JEOL Ltd.) according to a field desorption (FD) method.

There is no particular restriction on the melting point of the wax and any melting point can be appropriately selected depending on the purpose. The melting point is preferably from 40° C. to 160° C. and more preferably from 50° C. to 120° C. Where the melting point is less than 40° C., there is a case that the heat resistant storage stability may be adversely influenced. Where the melting point is in excess of 160° C., there is a case that cold offset may take place easily when an image is fixed at a low temperature.

Melting viscosity of the wax is preferably from 5 cps to 1,000 cps at a temperature which is 20° C. higher than the melting point and more preferably from 10 cps to 100 cps. Where the melting viscosity is in excess of 1,000 cps, there is a case that the hot offset resistance and fixing property at a low temperature may be improved to a lesser extent.

There is no particular restriction on the content of the wax in the toner and any content can be appropriately selected depending on the purpose. The content is preferably from 1% by mass to 40% by mass and more preferably from 3% by mass to 30% by mass.

-Binding Resin-

There is no particular restriction on the binding resin and any binding resin can be appropriately selected depending on the purpose. The binding resin includes, for example, styrene such as polystyrene, poly p-styrene, polyvinyl toluene, or a single polymer of its substitute thereof, a styrene-based copolymer such as styrene-p-chlorstyrene copolymer, styrene-propylene copolymer, styrene-vinyl toluene copolymer, styrene-acrylic acid methyl copolymer, styrene-acrylic acid ethyl copolymer, styrene-meta acrylic acid copolymer, styrene-meta acrylic acid methyl copolymer, styrene-meta acrylic acid ethyl copolymer, styrene-meta acrylic acid butyl copolymer, styrene-α-chlormeta acrylic acid methyl copolymer, styrene-acrylonitrile copolymer, styrene-vinylmethyl ether copolymer, styrene-vinyl methylketone copolymer, styrene-butadiene copolymer, styrene-isopropyl copolymer, styrene-maleic acid ester copolymer; polymethyl methacrylate resin, polybutyl methacrylate resin, polyvinyl chloride resin, polyvinyl acetate resin, polyethylene resin, polyester resin, polyurethane resin, epoxy resin, polyvinyl butyral resin, polyacrylic resin, rosin resin, modified rosin resin, terpene resin, phenol resin, aliphatic or aromatic hydrocarbon resin, aromatic petroleum resin. They may be used solely or in combination of two or more of them. Of these resins, in particular, preferable is polyester resin in view of an affinity with a recording medium to be fixed.

Components which configurate the polyester resin include, for example, a divalent alcohol component, a trivalent or higher multivalent alcohol component and an acid component.

The divalent alcohol component includes, for example, ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, hydrogenated bisphenol A, and diol obtained by polymerization of bisphenol A by cyclic ether such as ethylene oxide and propylene oxide.

The trivalent or higher multivalent alcohol component includes, for example, sorbitol, 1,2,3,6-hexane tetrol, 1,4-sorbitan, pentaerythritol, dipentaerythritol, tripenta erythritol, 1,2,4-butane triol, 1,2,5-pentatriol, glycerol, 2-methylpropane triol, 2-methyl-1,2,4-butane triol, trimethylol ethane, trimethylol propane, and 1,3,5-trihydroxy benzene.

The acid component includes, for example, benzene dicarboxylic acid such as phthalic acid, isophthalic acid, terephthalic acid or its anhydride; alkyl dicarboxylic acid such as succinic acid, adipic acid, sebacic acid, azelaic acid or its anhydride; unsaturated diprotic acid such as maleic acid, citraconic acid, itaconic acid, alkenyl succinic acid, fumaric acid and mesaconic acid; unsaturated diprotic acid anhydride such as maleic acid anhydride, citraconic acid anhydride, itaconic acid anhydride and alkenyl succinic acid anhydride; and trivalent or higher multivalent carboxylic acid components.

The trivalent or higher multivalent carboxylic acid component includes, for example, trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylene carboxypropane, tetra(methylene carboxy)methane, 1,2,7,8-octane tetracarboxylic acid, EnPol trimer acid or their anhydrides, and partially lower alkyl ester.

-Modified Polyester Capable of Reacting with Active Hydrogen Group-Containing Compound- The binding resin may contain a modified polyester (prepolymer) capable of reacting with an active hydrogen group-containing compound. The active hydrogen group-containing compound acts as an elongating agent and a cross-linking agent, when the modified polyester capable of reacting with the active hydrogen group-containing compound undergoes elongation reaction or cross-linking reaction in the process of producing toners. The modified polyester capable of reacting with the active hydrogen group-containing compound undergoes elongation reaction to increase in molecular weight, thereby, making it possible to effectively increase the heat resistant storage stability of toner and suppress an image from being sticky after the fixing step. In this case, there is no particular restriction on the modified polyester capable of reacting with the active hydrogen group-containing compound as long as it is capable of reacting with the active hydrogen group-containing compound. Any modified polyester can be appropriately selected depending on the purpose and includes, for example, a modified polyester which contains an isocyanate group, epoxy group, carboxylic acid, acid chloride group. Of these modified polyesters, preferable is a modified polyester which contains an isocyanate group.

There is no particular restriction on the active hydrogen group-containing compound as long as it contains an active hydrogen group. Any active hydrogen group-containing compound can be appropriately selected depending on the purpose. Where the modified polyester capable of reacting with the active hydrogen group-containing compound is a modified polyester which contains an isocyanate group, amines are preferable because they can be increased in molecular weight due to elongation reaction or cross-linking reaction with the isocyanate group-containing modified polyester.

There is no particular restriction on the amines and any amines can be appropriately selected depending on the purpose. The amines include, for example, phenylene diamine, diethyltoluene diamine, 4,4'-diaminodiphenyl methane, 4,4'-diamino-3,3'-dimethyl dicyclohexyl methane, diamine cyclohexane, isophorone diamine, ethylene diamine, tetramethylene diamine, hexamethylene diamine, diethylene triamine, triethylene tetramine, ethanol amine, hydroxyethyl aniline, aminoethyl mercaptan, amonopropyl mercaptan, aminopropionic acid, and aminocapronic acid. The amines also include ketimine compounds in which amino groups of the amines are blocked with ketones (such as acetone, methylethyl ketone, methylisobutyl ketone) and oxazolizone compounds.

-Coloring Agent-

There is no particular restriction on the coloring agents and any coloring agents can be appropriately selected depending on the purpose. They include, for example, carbon black, nigrosin dye, black iron oxide, naphthol yellow S, hansa yellow (10G, 5G, C), cadmium yellow, yellow iron oxide, Chinese yellow, chrome yellow, titan yellow, polyazo yellow, oil yellow, hansa yellow (GR, A, RN, R), pigment yellow L, benzidine yellow (G, GR), permanent yellow (NCG), Vulcan fast yellow (5G, R), tartrazine lake, quinoline yellow lake, anthrazane yellow BGL, isoindolinone yellow, red iron oxide, red lead, red vermilion, cadminum red, cadminum mercury red, antmony red, permanent red 4R, para red, fire red, para-chloro-ortho-nitroaniline red, lithol fast scarlet G, brilliant fast scarlet, brilliant carmine BS, permanent red (F2R, F4R, FRL, FRLL, F4RH), fast scarlet VD, Vulcan fast rubine B, brilliant scarlet G, lithol rubine GX, permanent red FSR, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, iron blue, anthraquinone blue, fast violet B, methyl violet lake, cobalt purple, manganese purple, dioxane violet, anthraquinone violet, chrome green, zinc green, chrome oxide, pyridiane, emerald green, pigment green B, naphthol green B, green gold, acid green lake, malachite green lake, phtharocyanine green, anthraquinone green, titanium oxide, zinc white, and lithopone. They may be used solely or in combination of two or more of them.

There is no particular restriction on the content of the coloring agent and any content can be appropriately selected depending on the purpose. The content is preferably from 1 part by mass to 15 parts by mass with respect to 100 parts by mass of the toner, and more preferably from 3 parts by mass to 10 parts by mass.

The coloring agent may be used as a master batch synthesized with a resin. There is no particular restriction on the resin and any resin can be appropriately selected from known resins depending on the purpose. The resin includes, for example, styrene or a polymer of a substitute thereof, styrene-based copolymer, polymethyl methacrylate resin, polybutyl methacrylate resin, polyvinyl chloride resin, polyvinyl acetate resin, polyethylene resin, polypropylene resin, polyester resin, epoxy resin, epoxypolyol resin, polyurethane resin, polyamide resin, polyvinyl butyral resin, polyacrylic resin, rosin, modified rosin, terpene resin, aliphatic hydrocarbon resin, alicyclic hydrocarbon resin and aromatic petroleum resin. They may be used solely or in combination of two or more of them.

<Other Components>

There is no particular restriction on the other components and any other components can be appropriately selected depending on the purpose. They include, for example, a charge control agent, a magnetic material and an external additive.

-Charge Control Agent-

There is no particular restriction on the charge control agent. A positive or negative charge control agent can be appropriately selected to use depending on whether a photoconductor is charged positively or negatively.

The negative charge control agent includes, for example, a resin or a compound which has an electron donor functional group, an azo dye and an organic acid metal complex.

Commercially available products of the negative charge control agent include, for example, Bontron (product No.: S-31, S-32, S-34, S-36, S-37, S-39, S-40, S-44, E-81, E-82, E-84, E-86, E-88, A, 1-A, 2-A, 3-A) (all of which are made by Orient Chemical Industries Ltd.); Kaya charge (product No.: N-1, N-2), Kaya set black (product No.: T-2, 004) (all of which are made by Nippon Kayaku Co., Ltd.); Aizen Spilon black (T-37, T-77, T-95, TRH, TNS-2) (all of which are made by Hodogaya Chemical Co., Ltd.); FCA-1001-N, FCA-1001-NB, FCA-1001-NZ (all of which are made by Fujikura Kasei Co., Ltd.). They may be used solely or in combination of two or more of them.

The positive charge control agent includes, for example, a basic compound such as nigosin dye; a cationic compound such as quaternary ammonium salt; a metal salt of higher fatty acid.

Commercially available products of the positive charge control agent include, for example, Bontron (product No.: N-01, N-02, N-03, N-04, N-05, N-07, N-09, N-10, N-11, N-13, P-51, P-52, AFP-B) (all of which are made by Orient Chemical Industries Ltd.); TP-302, TP-415, TP-4040 (all of which are made by Hodogaya Chemical Co., Ltd.); Copy blue PR, Copy charge (product No.: PX-VP-435, NX-VP-434) (all of which are made by Hoechst AG); FCA (product No.: 201, 201-B-1, 201-B-2, 201-B-3, 201-PB, 201-PZ, 301) (all of which are made by Fujikura Kasei Co., Ltd.); PLZ (product No.: 1001, 2001, 6001, 7001) (all of which are made by Shikoku Chemicals Corporation). They may be used solely or in combination of two or more of them.

There is no particular restriction on the content of the charge control agent and any content can be appropriately selected depending on, such as, types of a binding resin and a toner producing method which includes a dispersion method. The content of the charge control agent is preferably from 0.1 parts by mass to 10 parts by mass with respect to 100 parts by mass of the binding resin and more preferably from 0.2 parts by mass to 5 parts by mass. Where the content is in excess of 10 parts by mass, there is a case that the charging property of toner may be excessively large to reduce the effect of a charge control agent, thus resulting in an increased electrostatic suction force with a developing roller, thereby reducing the flowability of a developer and the density of an image. Where the content is less than 0.1 parts by mass, there is a case that charging starts poorly to result in insufficient charging quantity, which may easily affect a toner image.

-Magnetic Material-

The magnetic material includes, for example, (1) magnetic iron oxide such as magnetite, maghemite, ferrite or iron oxide which contains other metal oxides; (2) metal such as iron, cobalt, nickel, or an alloy of these metals with those such as aluminum, cobalt, copper, lead, magnesium, tin, zinc, antimony, beryllium bismuth, cadmium, calcium, manganese, selenium, titanium, tungsten, vanadium, or (3) a mixture thereof.

The magnetic material includes, for example, $Fe_3O_4$, $\gamma$-$Fe_2O_3$, $ZnFe_2O_4$, $Y_3Fe_5O_{12}$, $CdFe_2O_4$, $Gd_3Fe_5O_2$, $CuFe_2O_4$, $PbFer_2O$, $NiFe_2O_4$, $NdFe_2O$, $BaFe_{12}O_{19}$, $MgFe_2O_4$, $MnFe_2O_4$, $LaFeO_3$, iron particles, cobalt particles, and nickel particles. They may be used solely or in combination of o or more of them. Of these materials, particularly preferable are fine particles of triiron tetroxide and $\gamma$-diiron trioxide.

There is no particular restriction on the content of the magnetic material and any content can be appropriately selected depending on the purpose. The content is preferably from 10 parts by mass to 200 parts by mass with respect to 100 parts by mass of the binding resin and more preferably from 20 parts by mass to 150 parts by mass.

The magnetic material can be used as a coloring agent as well.

-External Additive-

The external additive includes inorganic fine particles which impart flowability, heat resistant storage stability, developing properties, transfer properties, charging properties, etc., to the toner.

The inorganic fine particles include, for example, silica, titania, alumina, cerium oxide, strontium titanate, calcium carbonate, magnesium carbonate, and calcium phosphate. They also include silica fine particles which are hydrophobized by silicone oil, hexamethyldisilazane, etc., and titanium oxide which is subjected to specific surface treatment.

The silica fine particles are commercially available and the commercially available products include, for example, Aerosil (product No.: 130, 200V, 200CF, 300, 300CF, 380, OX50, TT600, MOX80, MOX170, COK84, RX200, RY200, R972, R974, R976, R805, R811, R812, T805, 11202, VT222, RX170, RXC, RA200, RA200H, RA200HS, RM50, RY200, REA200) (all of which are made by Nippon Aerosil Co., Ltd.); HDK (product No.: H20, H2000, H3004, H2000/4, H2050EP, H2015EP, H3050EP, KHD50), HVK2150 (all of which are made by Wacker Chemie GmbH); Carbosil (product No.: L-90, LM-130, LM-150, M-5, PTG, MS-55, H-5 HS-5, EH-5, LM-150D, M-7D, MS-75D, TS-720, TS-610, TS-530) (all of which are made by Cabot Corporation). They may be used solely or in combination of two or more of them.

There is no particular restriction on the content of the inorganic fine particles and any content can be appropriately selected depending on the purpose. The content is preferably from 0.1 parts by mass to 5.0 parts by mass with respect to 100 parts by mass of the toner and more preferably from 0.8 parts by mass to 3.2 parts by mass.

The toner is preferably from 0.93 to 1.00 in average circularity which is an average value of circularity SR expressed by the following formula 1 and more preferably from 0.95 to 0.99. The average circularity is an index which shows a degree of irregularity of toner. When the toner is a complete sphere, the average circularity is 1.00, and the average circularity becomes a smaller value as the surface configuration of the toner becomes more complicated.

<Formula 1>

Circularity SR=(circumferential length of circle, the area of which is equal to projected area of toner particle)/(circumferential length of projected image of toner particle)

Where the average circularity is in a range of 0.93 to 1.00, the surface of toner particles is smooth, and a contact area between toner particles or a contact area between toner particles and a photoconductor is small, therefore, the toner particles are excellent in transfer properties. Further, since the toner particles are free of corners, a developer is agitated by a small torque inside a developing device, and agitation is carried out stably to produce no abnormal image. Still further, no angulate toner is found in toner for forming dots. Thus, when a recording medium is brought into contact under pressure for transfer, the pressure is applied uniformly to the toner in its entirety for forming the dots and a void space due to defect of transferred coloring agents is less likely to occur. In addition, toner is not angulated, therefore, the toner is small in pulverization force and will not damage or wear the surface of the photoconductor.

The average circularity can be measured by using, for example, a flow-type particle image analyzer (FPIA-1000 made by Sysmex Corporation).

The toner is preferably from 3 μm to 10 μm in volume average particle diameter and more preferably from 4 μm to 8 μm. Where the volume average particle diameter is less than 3 μm, there is a case that phenomena such as a reduction in transfer efficiency and a reduction in blade cleaning properties may easily occur. Where it is in excess of 10 μm, it may be difficult to suppress scattered printing of letters and lines.

Here, the toner can be measured for its volume average particle diameter by, for example, a Coulter-counter method. A device for measuring particle size distribution of the toner by the Coulter-counter method includes, Coulter-counter TA-II and Coulter Multisizer II (each of which is made by Beckman Coulter Inc.).

<<Toner Producing Method>>

There is no particular restriction on the toner producing method and any toner producing method can be appropriately selected depending on the purpose. The method includes, for example, a pulverization method, a polymerization method (suspension polymerization method and emulsion polymerization method) in which a monomer composition containing a specific polymerizable monomer is directly polymerized in an aqueous phase, a method in which a specific binding resin solution is emulsified or dispersed in an aqueous medium, a method in which toner is dissolved in a solvent to remove the solvent and effect pulverization, and a melting and spraying method.

-Pulverization Method-

The pulverization method is a method in which, for example, toner materials are melted and kneaded, thereafter, pulverized and classified to obtain the toner.

In the pulverization method, for the purpose of increasing the average circularity of the toner, it is acceptable that a mechanical impact force is applied to the obtained toner to control the configuration of the toner. The mechanical impact force is applied to the toner by using, for example, machines such as Hybridizer and Mechanofusion.

In melting and kneading the toner material, the toner materials are mixed and the thus prepared mixture is placed into a melting/kneading machine for melting and kneading. The melting/kneading machine includes, for example, a monoaxial continuous kneader, a biaxial continuous kneader and a batch-type kneader using a roll mill. The melting/kneading machine is commercially available and the commercially available machine includes, for example, a KTK-type biaxial extruder (made by Kobe Steel Ltd.), a TEM-type extruder (made by Toshiba Machine Co., Ltd.), a biaxial extruder (made by KCK Co., Ltd.), a PCM-type biaxial extruder (made by Ikegai Corp.), and a co-kneader (made by Buss AG). It is preferable that the above-described melting and kneading are carried out under proper conditions so as not to cause cleavage of molecular chains of a binding resin. More specifically, the melting and kneading are carried out at a temperature which is determined with reference to a softening point of the binding resin. Where the temperature is excessively higher than the softening point, the molecular chains are excessively cleaved. Where the temperature is excessively low, dispersion may not proceed.

In the pulverization process, a kneaded product obtained in the kneading process is pulverized. In this pulverization, it is preferable that the kneaded product is first roughly pulverized and then finely pulverized. In this case, such a method is preferably employed that particles are pulverized by being made to collide against a collision plate in jet streams, particles are pulverized by being made to collide with other particles in jet streams, or particles are pulverized at a narrow gap between a rotor which rotates mechanically and a stator.

In the classification, pulverized products obtained in the pulverization process are classified and adjusted so as to produce particles having a predetermined particle diameter. The classification can be carried out by using, for example, a cyclone, a decanter, or a centrifugal machine to remove fine particle portions.

After completion of the pulverization and classification, pulverized products are classified into streams by a centrifugal force or the like, thereby producing toner with a predetermined particle diameter.

-Suspension Polymerization Method-

In the suspension polymerization method, a coloring agent, a releasing agent, etc., are dispersed in an oil-soluble polymerization initiator and a polymerizable monomer, and a resultant thereof is emulsified and dispersed in an aqueous medium which contains a surfactant., a solid dispersing agent, etc., by an emulsion polymerization method to be described later. Thereafter, the resultant is subjected to polymerization reaction and granulated to obtain the toner.

The polymerization monomer includes, for example, acids such as acrylic acid, methacrylic acid, α-cyanoacrylic acid, α-cyanomethacrylic acid, itaconic acid, crotonic acid, fumaric acid, maleic acid and anhydrous maleic acid; acrylamide, methacrylamide, diacetone acrylamide or a methylol compound thereof; acrylate or methacrylate having amino groups such as vinylpyridine, vinylpyrolidone, vinylimidazole, ethyleneimine, and dimethylaminoethyl methacrylate. By partially using these, a functional group can be introduced into the surface of toner particles.

Further, a dispersing agent to be used is selected from those that have an acid group or a basic group, by which the dispersing agent is adsorbed and allowed to remain on the surface of the toner, by which a functional group can be introduced.

-Emulsion Polymerization Method-

In the emulsion polymerization method, a water-soluble polymerization initiator and a polymerizable monomer are emulsified in water by using a surfactant to synthesize latex by an ordinary emulsion polymerization technique. A dispersion prepared by dispersing a coloring agent, a releasing agent, etc., in an aqueous medium is provided independently, the dispersion is mixed and, thereafter, aggregated into a toner size, heated and fused to obtain the toner. Use of a monomer which is similar to that used in the suspension polymerization method as latex enables to introduce a functional group into the surface of the toner.

-Method for Emulsifying or Dispersing a Specific Binding Resin Solution into an Aqueous Medium- A method for emulsifying or dispersing a specific binding resin solution into the aqueous medium is such that a solution or dispersion solution of toner materials which contains at least a binding resin is emulsified or dispersed in the aqueous medium to prepare an emulsion solution or dispersion solution and, thereafter, toner is granulated (granulation in water). This method is formed of the following processes of [1] to [4], for example.

Process [1]: Preparation of Solution or Dispersion Solution of Toner Materials

A solution or dispersion solution of the toner materials is prepared by dissolving or dispersing the toner materials such as a coloring agent and a binding resin in an organic solvent. The organic solvent is removed on granulation of toner or after granulation thereof.

Process [2]: Preparation of Aqueous Medium

There is no particular restriction on the aqueous medium and any aqueous medium can be appropriately selected from known aqueous media. The aqueous medium includes, for example, water, alcohol mixable with the water, solvents such as dimethyl formaldehyde, tetrahydrofuran, cellosolves and lower ketones, or a mixture thereof. Of these media, water is particularly preferable.

The aqueous medium can be prepared by dispersing, for example, a dispersion stabilizing agent such as resin fine particles in the aqueous medium. There is no particular restriction on the quantity of the resin fine particles added to the aqueous medium, and any quantity can be appropriately selected depending on the purpose. The quantity is preferably from 0.5% by mass to 10% by mass.

There is no particular restriction on the resin fine particles as long as a resin is able to form an aqueous dispersion solution in an aqueous medium. The resin can be appropriately selected from known resins, including thermoplastic resins and thermosetting resins, for example, vinyl resin, polyurethane resin, epoxy resin, polyester resin, polyamide resin, polyimide resin, silicon resin, phenol resin, melamine resin, urea resin, aniline resin, ionomer resin, and polycarbonate resin. They may be used solely or in combination of two or more of them. Of these resins, preferable is such a resin that is formed at least with one type of those selected from vinyl resin, polyurethane resin, epoxy resin and polyester resin in view of high availability of an aqueous dispersion solution of resin fine particles in the shape of fine spheres.

Further, in the aqueous medium, it is preferable to use a dispersing agent in view of the fact that oil droplets of the solution or the dispersion solution are made stable on emulsification or dispersion to be described later, whenever necessary, to obtain a desired configuration and also make the particle size distribution sharp. There is no particular restriction on the dispersing agent, and any dispersing agent can be appropriately selected depending on the purpose. The dispersing agent includes, for example, a surfactant, a poor water-soluble inorganic compound dispersing agent, and a high molecular protective colloid. They may be used solely or in combination of two or more of them. Of these dispersing agents, in particular, preferable is a surfactant.

Process [3]; Emulsification or Dispersion

When the solution or the dispersion solution which contains the toner materials is emulsified or dispersed in the aqueous medium, it is preferable that the solution or the dispersion solution which contains the toner materials is dispersed, while being agitated in the aqueous medium.

There is no particular restriction on the dispersion method, and any dispersion method can be appropriately selected depending on the purpose. The dispersion method can be carried out by using, for example, a batch-type emulsifier such as a homogenizer (made by IKA GmbH), Polytron (made by Kinematica AG), TK Autohomo Mixer (made by Primix Corporation); a continuous-type emulsifier such as Ebara Milder (made by Ebara Corporation), TK Fill Mix, TK Pipeline Homomixer (made by Primix Corporation), a colloid mill (made by Kobelco Eco-Solutions Co., Ltd.), Slasher, Trigonal wet-type pulverizer (made by Nippon Coke & Engineering Co., Ltd.), Cavitron (made by Eurotec Ltd.), and Fine Flow Mill (made by Pacific Machinery & Engineering Co., Ltd.); a high-pressure emulsifier such as Microfluodizer (made by Mizuho Industrial Co., Ltd.), Nanomizer (made by Nanomizer Inc.) and APV Gaulin (made by Gaulin Inc.), a membrane emulsifier such as a membrane emulsifier (made by Reika Kogyo KK) a vibration-type emulsifier such as Vibro Mixer (made so by Reika Kogyo KK); and an ultrasonic emulsifier such as Ultrasonic Homogenizer (made by Branson Co., Ltd.). Of these machines, APV Gaulin, Homogenizer, TK Auto Homo Mixer, Ebara Milder, TK Fill Mix, and TK Pipeline Homomixer are, in particular, preferable in view of making the particle diameter uniform.

Where a modified polyester capable of reacting with an active hydrogen group-containing compound is contained in the solution or the dispersion solution as a binding resin, reactions proceed during emulsification or dispersion. There is no particular restriction on the reaction conditions. Any conditions can be appropriately selected depending on combination of a polymer capable of reacting with the active hydrogen group-containing compound and the active hydrogen group-containing compound. Reaction time is preferably from 10 minutes to 40 hours, and more preferably from 2 hours to 24 hours.

Process [4]: Removal of Solvent

Then, an organic solvent is removed from an emulsified slurry obtained by the emulsification or dispersion. The organic solvent is removed by, for example, (1) a method in which a reaction system in its entirety is gradually heated to completely remove the organic solvent in oil droplets, and (2) emulsified dispersions are sprayed into a dry atmosphere to completely remove a non-water-soluble organic solvent in oil droplets, thereby forming toner fine particles and also removing an aqueous dispersing agent through evaporation.

<Transfer Step and Transfer Unit>

The transfer step is a step in which the visible image is transferred to a recording medium. Preferable is an aspect in which an intermediate transfer member is used to primarily transfer a visible image on the intermediate transfer member and thereafter the visible image is secondarily transferred on the recording medium. More preferable is an aspect formed of a primary transfer step in which at least two color toners are used or preferably a full color toner is used as the toner to transfer a visible image on an intermediate transfer member to form a composite transferred image and a secondary transfer step in which the composite transferred image is transferred on a recording medium.

The transfer can be carried out by procedures in which, for example, the visible image is transferred with a transfer/electrification device to charge the electrostatic latent image bearing member and can be carried out by means of the transfer unit. A preferable aspect of the transfer unit is provided with a primary transfer unit for transferring a visible image on an intermediate transfer member to form a composite transferred image and a secondary transfer unit for transferring the composite transferred image on a recording medium.

There is no particular restriction on the intermediate transfer member and any intermediate transfer member can be appropriately selected from known transfer bodies depending on the purpose. The intermediate transfer member includes, for example, a transfer belt.

It is preferable that the transfer unit (the primary transfer unit and the secondary transfer unit) is at least provided with a transfer device for detaching and charging the visible image formed on the electrostatic latent image bearing member to the side of the recording medium. The transfer unit may be provided in one unit or two or more units.

The transfer device includes, for example, a corona transfer device by corona discharge, a transfer belt, a transfer roller, a pressure transfer roller and an adhesive transfer device.

There is no particular restriction on the recording medium as long as it is able to fix the toner. Any recording medium can be appropriately selected depending on the purpose.

There is no particular restriction on an embodiment of the recording medium and any embodiment can be appropriately selected depending on the purpose. The embodiment includes a three-dimensional object having a flat face and a curved face other than a sheet form. The recording medium may include, for example, a medium such as paper on which transparent toner is uniformly fixed to protect the surface of the paper (so-called varnish coat). There is no particular restriction on the material of the recording medium and any material can be appropriately selected depending on the purpose. The material includes, for example, generally available fiber which configures paper, cloth, etc., a plastic film such as an OHP sheet having a liquid transmission layer, metal, resin and ceramic.

<Fixing Step and Fixing Unit>

The fixing step is a step in which a fixing member having no releasing agent on a surface thereof is used to fix a transferred image on a recording medium. The fixing step may be carried out for every transfer of the image to the recording medium in using individual color toners or may be carried out at the same time, with the image being laminated in using the individual color toners.

There is no particular restriction on the fixing member as long as it is an oilless fixing member having no releasing agent on a surface thereof. Any fixing member can be appropriately selected depending on the purpose. Preferable is a known heat pressure unit. The heat pressure unit includes a combination of a heating roller and a pressure roller and a combination of a heating roller, a pressure roller and an endless belt.

The fixing member is preferably a unit which is provided with a heating body having a heating element, a film in contact with the heating body and a pressure member in contact with the heating body via the film under pressure, in which a recording medium having an unfixed image thereon is made to pass between the film and the pressure member, thereby heating and fixing the image. The heat pressure unit conducts heating usually at a temperature of 80° C. to 200° C.

<Overcoat Layer Forming Step and Overcoat Layer Forming Unit>

The overcoat layer forming step is a step in which an overcoat layer is formed on the fixed image by polymerizing an overcoat composition and can be carried out by the overcoat layer forming unit.

<<Overcoat Composition>>

The overcoat composition contains a polymerizable unsaturated compound and a surfactant. It is preferable that the composition contains a polymerizable oligomer and a photopolymerization initiator and also contains other components such as a sensitizing agent and a polymerization prohibiting agent, whenever necessary.

-Polymerizable Unsaturated Compound-

There is no particular restriction on the polymerizable unsaturated compound and any polymerizable unsaturated compound can be appropriately selected depending on the purpose. The polymerizable unsaturated compound includes, for example, a mono-functional polymerizable unsaturated compound, a di-functional polymerizable unsaturated compound, a tri-functional polymerizable unsaturated compound and tetra-functional or higher polymerizable unsaturated compound.

The polyfunctional polymerizable unsaturated compound is greater in curing speed than the mono-functional polymerizable unsaturated compound and more suitable for high-speed fixing but greater in volume shrinkage. A polymerizable unsaturated compound which shrinks greatly on curing reactions easily undergoes curling. It is, therefore, preferable to use to the extent possible a polymerizable unsaturated compound or a polymer thereof which is lower in volume shrinkage rate.

The polymerizable unsaturated compound is preferably 15% or less in volume shrinkage rate.

The mono-functional polymerizable unsaturated compound includes, for example, 2-ethylhexyl acrylate, 2-hydroxylethyl acrylate, 2-hydroxyethyl acrylate, 2-hydroxypropyl acrylate, benzyl acrylate, phenylglycol monoacrylate, cyclohexyl acrylate, ethylcarbitol acrylate, acryloylmorpholine, and ethoxydiethylene glycolacrylate.

The di-functional polymerizable unsaturated compound includes, for example, 1,4-butanediol diacrylate, 1,6-hexanediol diacrylate, 1,9-nonanediol diacrylate, tripropylene glycol diacrylate, tetraethyleneglycol diacrylate, bisphenol A ethylene oxide adduct diacrylate.

The tri-functional polymerizable unsaturated compound includes, for example, trimethylolpropane triacrylate, pentaerythritol triacrylate, and tris(2-hydroxyethyl)isocyanurate triacrylate.

The tetra-functional or higher polymerizable unsaturated compound includes, for example, pentaerythritol tetraacrylate, ditrimethylolpropane tetraacrylate, dipentaerythritolhydroxy pentaacrylate and dipentaerythritol hexaacrylate.

They may be used solely or in combination of two or more of them.

Of these compounds, particularly preferable are 1,6-hexanediol diacrylate, ethylcarbitol acrylate and acryloylmorpholine, in view of high fusion capacity (high affinity with a binding resin in toner).

At least one polymerizable unsaturated compound selected from the above-described compounds of 1,6-hexanediol diacrylate, ethylcarbitol acrylate and acryloylmorpholine is preferably from 20% by mass to 60% by mass in content, and more preferably from 30% by mass to 50% by mass. Where the content is less than 20% by mass, there is a case that an overcoat layer may be poorly attached. Where the content is in excess of 60% by mass, there is a possibility that before formation of the overcoat layer, an image may melt partially to disturb the image.

There is no particular restriction on the total content of the polymerizable unsaturated compounds in the overcoat composition and any total content can be appropriately selected depending on the purpose. The total content is preferably from 35% by mass to 90% by mass, more preferably from 45% by mass to 85% by mass and, in particular, preferably from 40% by mass to 75% by mass. Where the total content is less than 35% by mass, there is a case that the viscosity may be excessively high. Where it exceeds 90% by mass, there is a case that poor curing may take place, the viscosity may be excessively low and flexibility after curing may be deteriorated. The total content which is in the particularly preferable range is advantageous in obtaining appropriate viscosity and curing properties or forming a coat layer after curing.

-Polymerizable Oligomer-

There is no particular restriction on the polymerizable oligomer and any polymerizable oligomer can be appropriately selected depending on the purpose. The polymerizable oligomer includes, for example, polyester acrylate oligomer, epoxyacrylate oligomer, urethaneacrylate oligomer and diallylphthalate oligomer.

There is no particular restriction on the polyester acrylate oligomer and any polyester acrylate oligomer can be appropriately selected depending on the purpose. The polyester acrylate oligomer includes, for example, acrylic acid ester of polyester polyol obtained from multivalent alcohol and polybasic acid. The polyester acrylate oligomer exhibits excellent reactivity.

There is no particular restriction on the epoxy acrylate oligomer and an epoxy acrylate oligomer can be appropriately selected depending on the purpose. The epoxy acrylate oligomer includes, for example, epoxy acrylates obtained by reactions of acrylic acid with bisphenol-type epoxy, novolac-type epoxy and alicyclic epoxy. The epoxy acrylate is excellent in hardness, flexibility and curing properties.

There is no particular restriction on the urethane acrylate oligomer and any urethane acrylate oligomer can be appropriately selected depending on the purpose. The urethane acrylate oligomer includes, for example, urethane acrylate oligomers obtained by reaction of polyester polyol and polyether polyol with acrylic ester having diisocyanate and a hydroxyl group. A film which is flexible and strong can be provided by using the urethane acrylate oligomer.

The polymerizable oligomer may be used solely or in combination of two or more of them.

There is no particular restriction on the content of the polymerizable oligomer in the overcoat composition and any content can be appropriately selected depending on the purpose. The content is preferably from 5% by mass to 60% by mass, more preferably from 10% by mass to 50% by mass and, in particular, preferably from 20% by mass to 45% by mass. Where the content is less than 5% by mass, there is a case that poor curing may take place, the viscosity may be excessively low or the flexibility after curing may be deteriorated. Where it is in excess of 60% by mass, there is a case that attachment property may be deteriorated or the viscosity may be excessively high. The content which is in the particularly preferable range is advantageous in obtaining appropriate viscosity, curing properties, flexibility of an overcoat layer after curing and strength.

There is no particular restriction on P.I.I. (Primary Skin Irritation Index) of the polymerizable unsaturated compound and the polymerizable oligomer and any P.I.I. is appropriately selected depending on the purpose. The P.I.I. is preferably 1.0 or less. Where the P.I.I. is 5.0 or more, there is a case that skin irritation is too strong to cause a safety problem.

Further, it is preferable that hue of the polymerizable unsaturated compound and that of the polymerizable oligomer are close to colorless and transparent to the extent possible. The hue is preferably 2 or less according to Gardner's Gray Scale. Where the hue is in excess of 2 according to Gardner's Gray Scale, there is a case that an image portion may change in color or a background portion may change in color conspicuously.

-Surfactant-

The surfactant is allowed to be contained in the overcoat composition, thereby imparting adsorption to a boundary surface between toner and an overcoat composition or decreasing the surface tension of the overcoat composition to improve wettability.

There is no particular restriction on the surfactant and any surfactant can be appropriately selected depending on the purpose. The surfactant includes, for example, an anionic surfactant, a nonionic surfactant, a silicone surfactant and a fluoro surfactant.

The anionic surfactant includes, for example, sulfosuccinate, disulfonate, phosphate ester, sulphate, sulfonate, and a mixture thereof.

The nonionic surfactant includes, for example, polyvinyl alcohol, polyacrylic acid, isopropyl alcohol, acetylene-based diols, ethoxylated octylphenol, ethoxylated/branched secondary alcohol, perfluorobutane sulfonate and alkoxylated alcohol.

The silicone surfactant includes, for example, polyether-modified polydimethylsiloxane.

There is no particular restriction on the content of the surfactant in the overcoat composition and any content can be appropriately selected depending on the purpose. The content is preferably from 0.1% by mass to 5% by mass and more preferably from 0.5% by mass to 3% by mass. Where the content is less than 0.1% by mass, there is a case that the overcoat composition may be deprived of wettability. Where the content is in excess of 5% by mass, there is a case that the curing properties may be inhibited. The content which is in the more preferable range is advantageous in improving the wettability of the overcoat composition.

Photo-polymerization Initiator-

There is no particular restriction on the photo-polymerization initiator and any photo-polymerization initiator can be appropriately selected depending on the purpose. The photo-polymerization initiator includes, for example, benzophenone, benzoin ethyl ether, benzoin isopropyl ether and benzyl. The photo-polymerization initiator commercially available and the commercially available product thereof includes, for example, Irgacure 1300, Irgacure 369, Irgacure 907 (made by Ciba Specialty Chemicals Inc.) and Lucirin TPO (made by BASH GmbH).

When ultraviolet light is radiated to a mixture of the polymerizable oligomer or the polymerizable unsaturated compound with the photo-polymerization initiator, the photo-polymerization initiator produces a radical as shown in the formulae (I) and (II) given below. The radical causes an addition reaction, by which the polymerizable oligomer or the polymerizable unsaturated compound undergoes polymerization double bond. The addition reaction produces further radicals. And, the radicals repeat the addition reaction, by which the other polymerizable oligomers or the other polymerizable unsaturated compounds undergo polymerization double bond. As a result, polymerization reactions proceed as shown in the formula (III) given below.

(I) Hydrogen Atom Abstraction

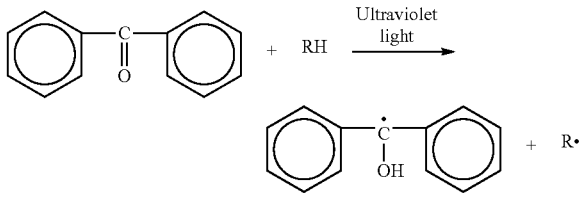

(II) Photofragmentation

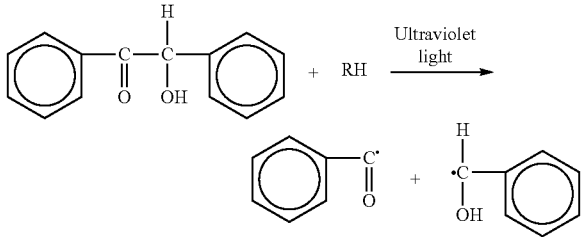

(III) Polymerization

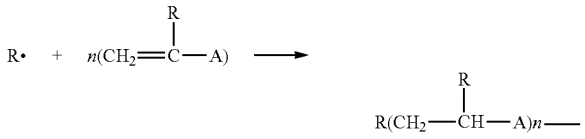

It is preferable that the photo-polymerization initiator is characterized by being (i) high in absorption efficiency of ultraviolet light, (ii) highly soluble in the polymerizable oligomer or the polymerizable unsaturated compound, (iii) low in odor, yellow discoloration and toxicity, and, (iv) free of dark reaction.

There is no particular restriction on the content of the photo-polymerization initiator in the overcoat composition and any content can be appropriately selected depending on the purpose. The content is preferably from 1% by mass to 10% by mass and more preferably from 2% by mass to 5% by mass.

-Sensitizing Agent-

Where there is used the hydrogen atom abstraction-type of benzophenone-based photo-polymerization initiator as shown in the formula (I), use of only the photo-polymerization initiator may delay reactions. Thus, it is preferable that an amine-based sensitizing agent is used in combination to raise the reactivity. The amine-based sensitizing agent is allowed to be contained therein, thereby providing such effects that hydrogen is supplied to the photo-polymerization initiator by hydrogen atom abstraction and reactions disturbed by oxygen in the atmosphere is prevented.

There is no particular restriction on the amine-based sensitizing agent and any amine-based sensitizing agent can be appropriately selected depending on the purpose. The amine-based sensitizing agent includes, for example, triethanol amine, triisopropanol amine, 4,4-diethyl aminobenzophenone, 2-dimethylaminoethyl benzoate, 4-dimethylamino ethyl benzoate and 4-dimethylamino isoacyl benzoate.

There is no particular restriction on the content of the sensitizing agent in the overcoat composition and any content can be appropriately selected depending on the purpose. The content is preferably from 1% by mass to 15% by mass and more preferably from 3% by mass to 8% by mass.

-Polymerization Prohibiting Agent-

The polymerization prohibiting agent is used for increasing storage stability of the overcoat composition.

There is no particular restriction on the polymerization prohibiting agent and any polymerization prohibiting agent can be selected appropriately depending on the purpose. The polymerization prohibiting agent includes, for example, 2,6-ditert-butyl-p-ceresol (BHT), 2,3-dimethyl-6-tert-butylphenol (IA), anthraquinone, hydroquinone (HQ) and monomethyl ether hydroquinone (MEHQ).

There is no particular restriction on the content of the polymerization prohibiting agent in the overcoat composition and any content can be appropriately selected depending on the purpose. The content is preferably from 0.5% by mass to 3% by mass.

-Other Components-

The other components include, for example, a leveling agent, a matting agent, waxes for adjusting film physical properties, and a polymerization inhibition-free tackifier (viscosity imparting agent) which improves the attachment property of polyolefin, polyethyleneterephthalate (PET) or the like to a recording medium.

There is no particular restriction on the viscosity of the overcoat composition and any viscosity can be appropriately selected depending on the purpose. The viscosity is preferably from 30 mPa·s to 700 mPa·s at 25° C. and more preferably from 200 mPa·s to 500 mPa·s. Where the viscosity is less than 30 mPa·s or in excess of 700 mPa·s, it may be difficult to control the coating thickness of the overcoat composition.

The viscosity can be measured by using, for example, a Brookfield type viscometer (made by Toyo Seiki Seisakusho, Ltd.).

The overcoat composition can be prepared as an oil-type by using a solvent. An ultraviolet light-curing type (photo-curing type) prepared by UV is preferable in terms of ensuring safety, environmental protection, energy saving and high productivity.

The overcoat composition is coated on a fixed image on the recording medium after the fixing step. For example, the overcoat composition is coated on the recording medium immediately after formation of a fixed image as performed in in-line coating which is carried out by one printing device for conducting printing and final coating, or at a lapse of short or long delay after printing as done in off-line coating in which printing and final coating are conducted by different printing devices.

The coating is not necessarily given all over to the recording medium or the fixed image, as long as the overcoat composition is coated at least on a part of the fixed image formed on the recording medium. The overcoat composition can be appropriately selected depending on the purpose such as protecting the printing surface or imparting gloss.

There is no particular restriction on the coating unit and any coating unit can be appropriately selected depending on the purpose. The coating unit includes, for example, a liquid film coating machine such as roll coater, flexo coater, rod coater, blade, wire bar, air knife, curtain coater, slide coater, doctor knife, screen coater, gravure coater (for example, offset gravure coater), slot coater, extrusion coater and inkjet coater. Coating carried out by the above-described coaters includes, for example, forward and reverse rotating roll coating, offset gravure, curtain coating, lithograph coating, screen coating, gravure coating and inkjet coating.

There is no particular restriction on the average thickness of the overcoat layer and any average thickness can be appropriately selected depending on the purpose. The average thickness is preferably from 1 μm to 15 μm. Where the average thickness is less than 1 μm, there is a case that repelling may take place or gloss is insufficiently imparted. Where the average thickness is in excess of 15 μm, there is a case that an image may be decreased in texture.

Next, where the overcoat composition is a photo-curing type overcoat composition, light (mainly ultraviolet light) from a light source is radiated to effect curing.

Moreover, where the overcoat composition is an oil-based overcoat composition, heating can be given to effect curing.

There is no particular restriction on the light source and any light source can be appropriately selected depending on the purpose. The light source includes, for example, low-pressure mercury-vapor lamp, medium-pressure mercury-vapor lamp, high-pressure mercury-vapor lamp, ultra-high pressure mercury-vapor lamp, xenon lamp, carbon arc lamp, metal halide lamp, fluorescent lamp, tungsten lamp, argon ion laser, helium cadmium laser, helium neon laser, krypton ion laser, various types of semiconductor laser, YAG laser, light emitting diode, CRT light source, plasma light source, electron beam, γ rays, ArF excimer laser, KrF excimer laser, and F2 laser.

Figure 3:
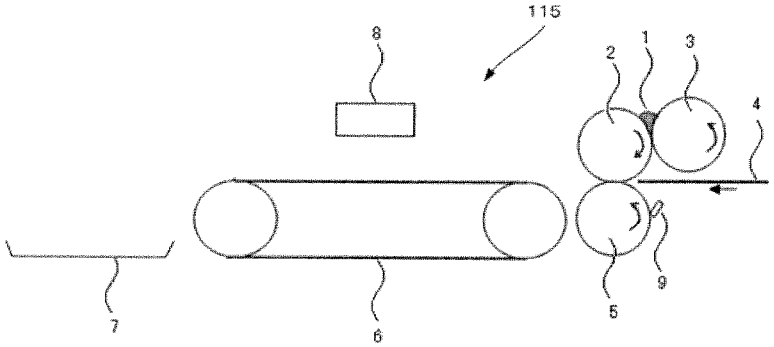
FIG. 3 is a schematic diagram which shows one example of an overcoat layer forming unit.

Here, FIG. 3 is a schematic diagram which shows one example of the overcoat layer forming unit. An overcoat layer forming unit 115 shown in FIG. 3 is provided with a coating roller 2, a metal roller 3, a pressing roller 5, a conveyance belt 6, a tray 7, a light source 8 and a scraper 9.

An overcoat composition 1 is pooled between the coating roller 2 and the metal roller 3. A recording medium 4 on which a visible image has been formed passes through a space between the coating roller 2 and the pressing roller 5, while being in contact with the coating roller 2 and the pressing roller 5 rotating in a direction shown with arrows in the drawing. At this time, the overcoat composition 1 on the surface of the coating roller 2 is transferred to the recording medium 4, by which the overcoat composition 1 is coated on the recording medium 4.

The recording medium 4 on which the overcoat composition 1 has been coated is conveyed by the conveyance belt 6 and passes below the light source 8. At this time, ultraviolet light is radiated from the light source 8 to cure the overcoat composition 1 coated on the recording medium 4. Thereafter, the recording medium 4 moves onto the tray 7. Moreover, the unnecessary overcoat composition 1 adhered on the pressing roller 5 is removed by the scraper 9.

The overcoat layer forming unit 115 may be formed integrally with an image forming apparatus or separated from the apparatus.

<Other Steps and Other Units>

-Charge Eliminating Step and Charge Eliminating Unit-

The charge eliminating step is a step in which charge eliminating bias is applied to the electrostatic latent image bearing member to eliminate charge and can be favorably carried out by a charge eliminating unit.

There is no particular restriction on the charge eliminating unit. Any charge eliminating unit can be appropriately selected from known charge eliminating devices, as long as the charge eliminating bias can be applied to the electrostatic latent image bearing member. The charge eliminating unit includes, for example, a charge eliminating lamp.

-Cleaning Step and Cleaning Unit-

The cleaning step is a step of removing the toners remaining on the electrostatic latent image bearing member and can be favorably carried out by a cleaning unit.

There is no particular restriction on the cleaning unit. Any cleaning unit can be appropriately selected from known cleaners, as long as the electrophotographic toner remaining on the electrostatic latent image bearing member can be removed. The cleaning unit includes, for example, a magnetic brush cleaner, an electrostatic brush cleaner, a magnetic roller cleaner, a blade cleaner, a brush cleaner, and a web cleaner.

-Recycle Step and Recycle Unit-

The recycle step is a step in which the toner which has been removed in the cleaning step is recycled by the development unit and can be favorably carried out by the recycle unit.

There is no particular restriction on the recycle unit and any recycle unit can be used, such as known conveyance units.

-Control Step and Control Unit-

The control step is a step of controlling the individual steps described so far and can be carried out favorably by the control unit.

There is no particular restriction on the control unit as long as it is capable of controlling movements of the individual units. Any control unit can be appropriately selected depending on the purpose. The control unit includes, for example, devices such as a sequencer and a computer.

Figure 4:
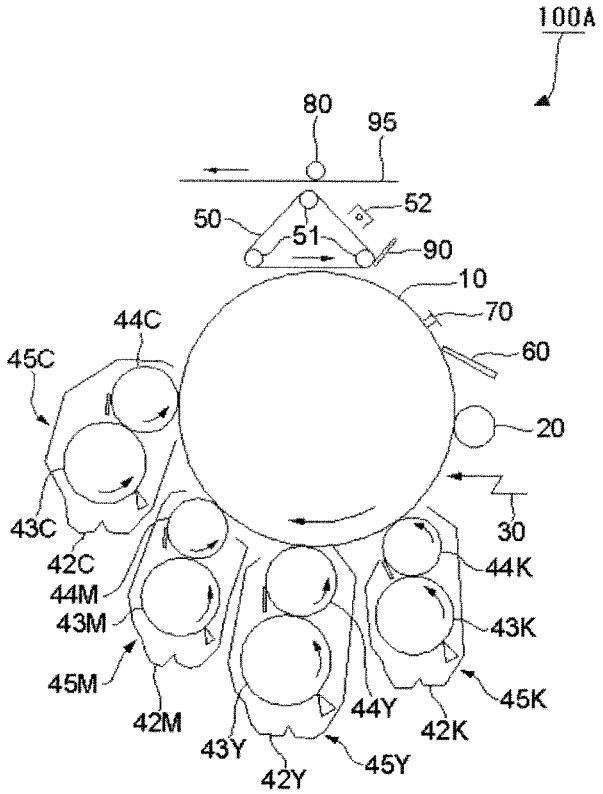
FIG. 4 is a schematic diagram which shows one example of a color image forming apparatus of the present invention.

Here, FIG. 4 is a schematic diagram which shows an example of the color image forming apparatus of the present invention. An image forming apparatus 100A given in FIG. 4 is provided with a photosensitive drum 10, the charging roller 20 as a charging unit, an exposure device (not illustrated) as an exposure unit, developing devices as development units (black developing device 45K, yellow developing device 45Y, magenta developing device 45M and cyan developing device 45C), an intermediate transfer member 50, a cleaner 60 having a cleaning blade as a cleaning unit and a charge eliminating lamp 70 as a charge eliminating unit.

The intermediate transfer member 50 is an endless belt which is laid across by three rollers 51 installed internally and able to move in a direction indicated by an arrow. A portion of the three rollers 51 also acts as a transfer bias roller capable of applying a predetermined transfer bias (primary transfer bias) to the intermediate transfer member 50.

Further, the cleaner 90 having the cleaning blade is disposed in the vicinity of the intermediate transfer member 50. Moreover, a transfer roller 80 as a transfer unit capable of applying transfer bias for transferring a toner image (secondary transfer) on a recording medium 95 is disposed so as to oppose the intermediate transfer member 50.

Still further, a corona electrifier 52 for imparting electric charges to a toner image on the intermediate transfer member 50 is disposed between a part of the intermediate transfer member 50 in contact with the photosensitive drum 10 and a part of the recording medium 95 in contact with the intermediate transfer member 50 around the intermediate transfer member 50.

The developing devices of black color (K), yellow color (Y), magenta color (M) and cyan color (C) (black developing device 45K, yellow developing device 45Y, magenta developing device 45M, cyan developing device 45C) are respectively provided with developer containers (42K, 42Y, 42M, 42C), developer supplying rollers (43K, 43Y, 43M, 43C) and developing rollers (44K, 44Y, 44M, 44C).

In the image forming apparatus 100A, the charging roller 20 is used to uniformly charge the photosensitive drum 10 and, thereafter, an exposure device (not illustrated) is used to expose exposure light 30 imagewise on the photosensitive drum 10, thereby forming an electrostatic latent image. Next, the electrostatic latent image formed on the photosensitive drum 10 is developed by supplying developers from the developing devices (black developing device 45K, yellow developing device 45Y, magenta developing device 45M, cyan developing device 45C) to form a toner image and, thereafter, the toner image is transferred on the intermediate transfer member 50 (primary transfer) by transfer bias applied from the roller 51. Further, the toner image on the intermediate transfer member 50 is given electric charges by the corona electrifier 52 and, thereafter, transferred on the recording medium 95 (secondary transfer). Toners remaining on the photosensitive drum 10 are removed by the cleaner 60, and the photosensitive drum 10 is temporarily subjected to charge elimination by the charge eliminating lamp 70.

Moreover, in the image forming apparatus 100A, an overcoat layer forming unit (not illustrated) can be placed at any given location after the toner image is fixed.

Figure 5:
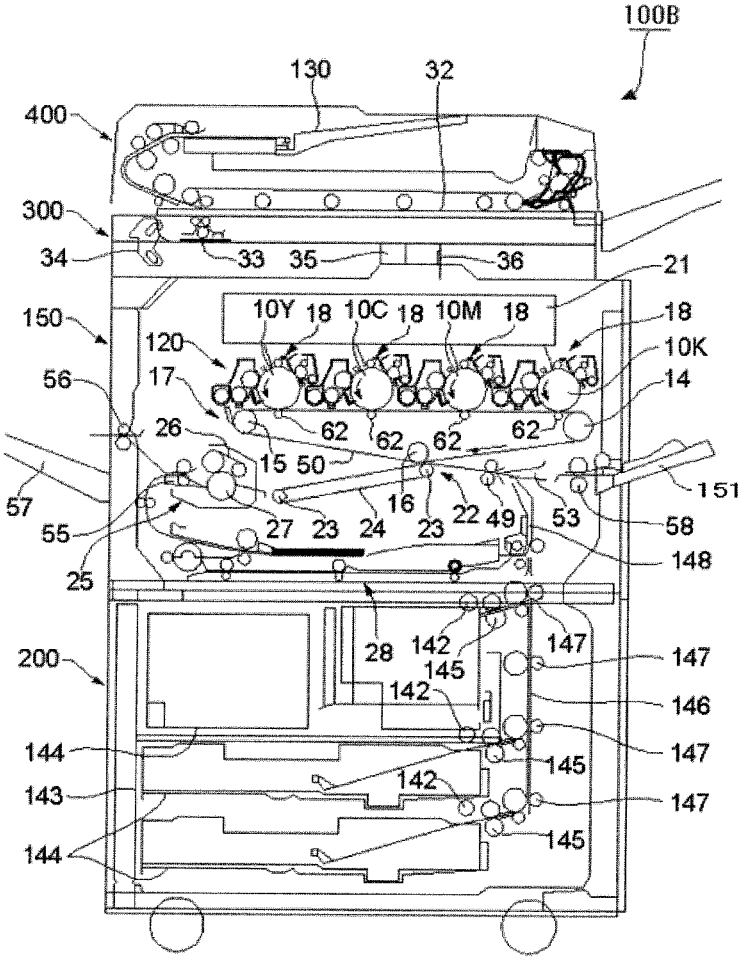
FIG. 5 is a schematic diagram which shows another example of the color image forming apparatus of the present invention.

FIG. 5 is a schematic diagram which shows another example of the color image forming apparatus of the present invention. An image forming apparatus 100B is a tandem-type color image forming apparatus and provided with a copier main body 150, a sheet feeding table 200, a scanner 300 and an automatic document feeder (ADF) 400.

The copier main body 150 is provided with an endless-belt like intermediate transfer member 50 at the center part thereof. The intermediate transfer member 50 is laid across by supporting rollers 14, 15, 16 and able to rotate in a direction indicated by an arrow.

A cleaner 17 for removing toners remaining on the intermediate transfer member 50 is disposed in the vicinity of the supporting roller 15. Further, a tandem-type developing device 120 on which four image forming units 18 of yellow, cyan, magenta and black are installed in parallel so as to be opposed is disposed on the intermediate transfer member 50 laid across by the supporting roller 14 and the supporting roller 15 in a conveyance direction thereof.

Figure 6:
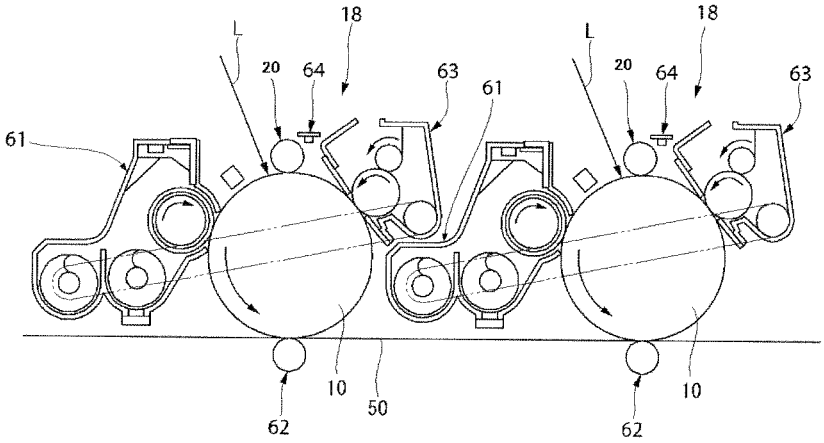
FIG. 6 is an enlarged view which shows a tandem-type developing device given in FIG. 5.

As shown in FIG. 6, each of the image forming units 18 of these colors is provided with the photosensitive drum 10, the charging roller 20 for uniformly charging the photosensitive drum 10, a developing device 61 for developing the electrostatic latent image formed on the photosensitive drum 10 with each of the developers of black (K), yellow (Y), magenta (M) and cyan (C) to form a toner image, a transfer roller 62 for transferring the color toner images of each color on the intermediate transfer member 50, a cleaner 63 and a charge eliminating lamp 64.

Further, an exposure device 21 is disposed in the vicinity of the tandem-type developing device 120. The exposure device 21 exposes exposure light L on the photosensitive drums 10 (black photoconductor 10K, yellow photoconductor 10Y, magenta photoconductor 10M and cyan photoconductor 10C) to form an electrostatic latent image.

Still further, a secondary transfer device 22 is disposed on the opposite side to the side where the tandem-type developing device 120 of the intermediate transfer member 50 is disposed. The secondary transfer device 22 is formed of a secondary transfer belt 24 which is an endless belt laid across by a pair of rollers 23 and configured in such a manner that recording paper conveyed on the secondary transfer belt 24 and the intermediate transfer member 50 are allowed to be in contact with each other.

A fixing apparatus 25 is disposed in the vicinity of the secondary transfer device 22. The fixing apparatus 25 is provided with a fixing belt 26 which is an endless belt and a pressure roller 27 which is disposed so as to be pressed by the fixing belt 26.

In addition, a sheet reversing device 28 for reversing recording paper to form an image on both sides of the recording paper is disposed in the vicinity of the secondary transfer device 22 and the fixing apparatus 25.

Next, a description will be given of a full color image formation (color copy) by using the image forming apparatus 100B.

First, documents are set on a document counter 130 of the automatic document feeder (ADF) 400 or the automatic document feeder 400 is opened to set documents on a contact glass 32 of the scanner 300, then, the automatic document feeder 400 is closed. Next, depression of a start switch (not illustrated) will actuate the scanner 300 after documents are conveyed and moved to the contact glass 32 when the documents are set on the automatic document feeder 400, whereas actuating the scanner 300 immediately when the documents are set on the contact glass 32, thereby allowing a first traveling body 33 and a second traveling body 34 to travel. At this time, light from a light source is radiated from the first traveling body 33, and also light reflected from the surface of the documents is reflected on a mirror of the second traveling body 34 and received by a reading sensor 36 through an imaging lens 35. Thereby, color documents (color images) are read to give image information of each color, that is, black, yellow, magenta and cyan.

Further, after an electrostatic latent image of each color is formed on the photosensitive drum 10 on the basis of image information of each color obtained by the exposure device 21, the electrostatic latent image of each color is developed by a developer supplied from the developing devices 61 for the respective colors to form a toner image of each color. The thus formed toner image of each color is sequentially laminated on the intermediate transfer member 50 which moves rotationally by the supporting rollers 14, 15 and 16, and transferred (primary transfer) to form a composite toner image on the intermediate transfer member 50.

In the sheet feeding table 200, one of the sheet feeding rollers 142 is selectively rotated to deliver recording paper from one of the sheet feeding cassettes 144 provided in a multistage manner on a paper bank 143. The thus delivered recording paper is separated one by one by a separation roller 145 and sent to a sheet feeding path 146, then, the recording paper is conveyed by a conveyance roller 147 and guided into a heat feeding path 148 inside a copier main body 150 and stopped by hitting the recording paper against a resist roller 49. Alternatively, recording paper on a manual tray 151 is delivered, separated one by one by a separation roller 58, placed in a manual sheet feeding path 53 and stopped by hitting the recording paper against the resist roller 49. It is noted that the resist roller 49 is in general grounded before use, but in this case the roller 49 may be used, with bias being applied, to remove dust on the recording paper.

Then, the resist roller 49 is rotated in synchronization with a composite toner image formed on the intermediate transfer member 50, by which the recording paper is sent between the intermediate transfer member 50 and the secondary transfer device 22. The composite toner image is transferred (second transfer) on the recording paper.

The recording paper on which the composite toner image has been transferred is conveyed by the secondary transfer device 22 and sent to a fixing apparatus 25. Then, the composite toner image is heated and pressed on the fixing apparatus 25 by the fixing belt 26 and the pressure roller 27 and fixed on the recording paper. Thereafter, the recording paper is changed over by a change-over pawl 55 and discharged by a discharge roller 56 and stacked on a discharge tray 57. Alternatively, the recording paper is changed over by the change-over pawl 55, reversed by the sheet reversing device 28 and again guided into a transfer position to form an image on the back face as well. Thereafter, the paper is discharged by the discharge roller 56 and stacked on the discharge tray 57.

It is noted that toners remaining on the intermediate transfer member 50 after transfer of the composite toner image are removed by the cleaner 17.

In the image forming apparatus 100B, an overcoat layer forming unit (not illustrated) can be placed at any given place, after the toner image is fixed.

According to the color image forming method and the color image forming apparatus of the present invention, it is possible to effectively form a high-grade and beautiful image which is great in durability even in formation of a color image which is greater in content of a releasing agent and lower in attachment property to an overcoat layer than a black-and-white image.

EXAMPLES

Hereinafter, a detailed description will be given of the present invention with reference to examples, to which the present invention shall not be, however, limited in any way.

In the following examples and comparative examples, the resin was measured for its weight-average molecular weight and glass transition temperature and the wax was measured for its isoparaffin content and weight-average molecular weight by the following methods.

<<Weight-Average Molecular Weight>>

The weight-average molecular weight of the resin was measured by a gel permeation chromatography (GPC). A column was stabilized in a heat chamber kept at 40° C. Tetrahydrofuran (THF) as a solvent was fed at a flow rate of 1mL/minute to the column stabilized at this temperature, thereby preparing a THF sample solution of the resin, the sample concentration of which was adjusted from 0.05% by mass to 0.6% by mass. The weight-average molecular weight was measured by feeding the thus prepared THF sample solution at a quantity of 50 μL to 200 μL.

On measurement of the molecular weight of the sample, the sample was calculated for its molecular weight distribution with reference to a relationship between logarithmic values and number of counts of a standard curve prepared by several types of monodisperse polystyrene standard samples. The polystyrene standard samples for preparing the standard curve include those having the following molecular weights, $6\times10^2$, $2.1\times10^2$, $4\times10^3$, $1.75\times10^4$, $5.1\times10^4$, $1.1\times10^5$, $3.9\times10^5$, $8.6\times10^5$, $2\times10^6$, $4.48\times16^6$ (made by Pressure Chemical Co. or Tosoh Corporation). It is appropriate to use at least 10 polystyrene standard samples. Further, an RI (refraction index) detector was used as a detector.

<<Glass Transition Temperature>>

The glass transition temperature of the resin was measured with reference to a DSC curve obtained by means of a differential scanning calorimetry (DSC). TA-60W and DSC-60 (made by Shimadzu Corporation) were used to obtain the DSC curve and the glass transition temperature was measured under the following conditions.

[Measurement Conditions]

Sample container: aluminum-made sample pan (with lid)
Sample quantity: 5 mg
Reference: aluminum-made sample pan (alumina 10 mg)
Atmosphere: nitrogen (flow rate: 50 mL/minute)
Temperature conditions
Temperature at the start: 20° C.
Temperature elevation speed: 10° C./minute
Temperature at the end: 150° C.
Retention time: none
Temperature lowering speed: 10° C./minute
Temperature at the end: 20° C.
Retention time: none
Temperature elevation speed: 10° C./minute
Temperature at the end: 150° C.

The above measurement results were analyzed with reference to the data analysis software TA-60 version 1.52 (made by Shimadzu Corporation).

In analysis of the measurement results, a range of ±5° C. was specified on the basis of a maximum peak found on a DSC differential curve of a second temperature elevation which is a DrDSC curve, and peak analysis functions of the data analysis software were used to determine a peak temperature. Next, in a range of the peak temperature of the DSC curve from +5° C. to −5° C., the peak analysis functions of the data analysis software were used to determine a maximum endothermic temperature of the DSC curve. This temperature corresponds to a melting point.

At an endothermic peak of a main peak in a range from 40° C. to 100° C. obtained during the temperature elevation, an intersecting point between a line formed by middle points of a baseline before and after the endothermic peak and a differential calorimetry curve was given as a glass transition temperature (Tg).

<<Isoparaffin Content in Wax and Weight-Average Molecular Weight of Wax>>

The isoparaffin content (% by mass) in the wax and the weight-average molecular weight of the wax were measured by using JMS-T100GC "AccuTOF GC" (made by JEOL Ltd.) as a gas chromatograph TOF-type mass spectrometer according to a FD (field desorption) method.

Example 1

<Preparation of Toner 1>

[Formulation]

Polyester resin (weight-average molecular weight Mw: 68,500, glass transition temperature Tg: 65.9° C.) . . . 89.5 parts by mass
Microcrystalline wax (isoparaffin content: 15% by mass, weight-average molecular weight Mw: 645) . . . 5 parts by mass
Carbon black (#44, made by Mitsubishi Kasei Corp.) . . . 5 parts by mass
Charge control agent (Spiron black TR-H made by Hodogaya Chemical Co., Ltd.) . . . 1 part by mass After the above-described formulation was mixed and kneaded at 120° C. by using a biaxial extruder (BCTA-type, made by Buehler GmbH), it was pulverized and classified to give a weight average particle diameter of 11.0 μm by using an air-flow pulverizer (jet mill, made by Nisshin Engineering Inc.). Then, the formulation was mixed with 2.2% by mass of silica (R-972, made by Nippon Aerosil Co., Ltd.) by using a Henschel mixer (FM-type, made by Nippon Coke & Engineering Co., Ltd.) to prepare black toner 1.

Yellow toner 1 was prepared in the same manner as in the black toner 1 except that C.I. Pigment Yellow 17 was used in place of the carbon black in production of the black toner 1.

Magenta toner 1 was prepared in the same manner as in the black toner 1 except that C. I. Pigment Red 57 was used in place of the carbon black in production of the black toner 1.

Cyan toner 1 was prepared in the same manner as in the black toner 1 except that C.I. Pigment Blue 15 was used in place of the carbon black in production of the black toner 1.

The thus obtained black, yellow, magenta and cyan toners 1 were measured for an average circularity and volume average particle diameter Dv by the following procedures, and the average circularity was 0.90 and volume average particle diameter Dv was 8.0 μm.

<Average Circularity>

The average circularity of toners was measured by using a flow-type particle image analyzer ("FPIA-2100" made by Sysmex Corporation) and analysis was made by using the analysis software (FPIA-2100 Data Processing Program for FPIA Version 00-10). More specifically, 10% by mass of a surfactant (alkylbenzene sulfonate, Neogen SC-A, made by Dai-Ichi Kogyo Seiyaku Co., Ltd.) was added into a glass beaker (100 mL) at a quantity of 0.1 mL to 0.5 mL and each of the toners was added at a quantity of 0.1 g to 0.5 g. Then, the resultant was mixed by using a microspatula and ion exchanged water was then added thereto at a quantity of 80 mL. The thus obtained dispersion solution was dispersed for three minutes by using an ultrasonic homogenizer (made by Honda Electronics Co., Ltd.). The FPIA-2100 was used to measure the configuration and distribution of each toner until the dispersion solution gave concentrations of 5,000 particles/μL to 15,000 particles/μL.

In the above measurement, it is important that dispersion solution gives concentrations of 5,000 particles/μL to 15,000 particles/μL in order to measure the average circularity at a high reproducibility.

<Volume Average Particle Diameter Dv of Toners>

Regarding a volume average particle diameter (Dv) of toners, a Coulter Multisizer III type measuring device (made by Beckman Coulter Inc.) was connected to a PC-9801 personal computer (made by NEC Corporation) via an interface (made by The Institute of JUSE) for outputting the number distribution and volume distribution, by which the particle size distribution was measured.

More specifically, a surfactant (alkyl benzene sulfonate) was added at a quantity of 0.1 mL to 5 mL as a dispersing agent to 100 mL to 150 mL of an electrolyte solution. It is noted that the electrolyte solution was obtained by preparing 1% by mass of an aqueous solution by using primary sodium chloride. ISOTON-II (made by Beckman Coulter Inc.) was used.

Then, a sample was added at a quantity of 2 mg to 20 mg to cause suspension and, thereafter, a resultant was dispersed for 1 minute to 3 minutes by using an ultrasonic homogenizer. The volume and number of toners were measured from the thus obtained dispersion solution through a 100-μm aperture to calculate the volume distribution and number distribution.

The following 13 channels were used, that is, 2.00 μm or more but less than 2.52 μm; 2.52 μm or more but less than 3.17 μm; 3.17 μm or more but less than 4.00 μm; 4.00 μm or more but less than 5.04 μm; 5.04 μm or more but less than 6.35 μm; 6.35 μm or more but less than 8.00 μm; 8.00 μm or more but less than 10.08 μm; 10.08 μm or more but less than 12.70 μm; 12.70 μm or more but less than 16.00 μm; 16.00 μm or more but less than 20.20 μm; 20.20 μm or more but less than 25.40 μm; 25.40 μm or more but less than 32.00 μm; 32.00 μm or more but less than 40.30 μm. Particles with the particle diameter of 2.00 μm or more to less than 40.30 μm were to be measured.

<Preparation of Developers 1>

A carrier prepared by coating a silicone resin on magnetite particles with a volume average particle diameter of 50 μm so as to give an average thickness of 0.5 μm was used to mix the toners 1 for the respective colors so as to give a toner concentration of 5.0% by mass, thereby preparing each of the black, yellow, magenta and cyan developers 1.

<Formulation of Overcoat Composition 1>

9 parts by mass of pentaerythritol tetraacrylate as a polymerizable unsaturated compound, 2.5 parts by mass of ethoxydiethylene glycol acrylate as a polymerizable unsaturated compound, 30 parts by mass of trimethylolpropane triacrylate as a polymerizable unsaturated compound and 0.3 parts by mass of hydroquinone as a polymerization prohibiting agent were put into a beaker and heated up to 120° C. while agitating, and 50 parts by mass of a diallylphthalate prepolymer (Daiso Dap 100, made by Daiso Co., Ltd.) was dissolved therein. Further, a substance prepared by dissolving 2 parts by mass of aluminum isopropylate in 2 parts by mass of toluene was gradually added and agitated for 20 minutes at 110° C. During this time, toluene added as a solvent was removed from a system. Thereby, a photo-curing varnish agent was obtained.

Next, 75 parts by mass of the photo-curing varnish base agent, 60 parts by mass of 1,6-hexanediol diacrylate as a polymerizable unsaturated compound, 10 parts by mass of benzophenone as a photo-polymerization initiator, 5 parts by mass of p-dimethylamino acetophenone, and 10 parts by mass of phenylglycol monoacrylate as a viscosity adjusting agent were mixed and well kneaded by using a three roll mill. Thus, obtained was a photo-curing overcoat composition 1.

The thus obtained overcoat composition 1 was measured for viscosity by the following procedures, which was 200 mPa·s.

<Measurement of Viscosity>

The viscosity of the overcoat composition was measured at 25° C. by using a Brookfield type viscometer (made by Toyo Seiki Seisaku-sho, Ltd.).

<Fusion (Color Difference ΔE*) Test>

A color image forming apparatus (IMAGIO MP C7500, made by Ricoh Company Ltd.) was used to form a red-color fixed solid image prepared by overlapping two color toners of magenta and yellow (wax content of 10% by mass, toner adhesion quantity of 0.8 mg/cm$^2$) on an OHP sheet (for PPC (plain paper opier), A4-size sheet, without cut 27054, made by A-One Co., Ltd.). The OHP sheet on which the red-color fixed solid image was formed was sandwiched with another OHP sheet and a spectroscopic densitometer (X-Rite 938, made by X-Rite Incorporated) was used to measure lightness L1, chromaticity a1 and chromaticity b1 of the image according to the L*a*b* color system (before titration). The OHP sheet was sandwiched with another OHP sheet in order to keep the spectroscopic densitometer (X-Rite 938, made by X-Rite Incorporated) clean.

Next, a fusion tester shown in FIG. 7 was used to put an overcoat composition 114 into a dropping burette 113 so as to be 10 mm in height above the red-color fixed solid image formed on the OHP sheet 112 which was placed on a titration base 111. Next, the overcoat composition 114 was dropped at a quantity of 0.4 mg and the overcoat composition 114 was removed by using a microwipe MU-2000 (made by MCC Co., Ltd.) after 10 seconds passed. The OHP sheet on which the red-color fixed solid image was formed was sandwiched with another OHP sheet and the spectroscopic densitometer (X-Rite 938, made by X-Rite Incorporated) was used to measure lightness L2, chromaticity a2 and chromaticity b2 of the image according to the L*a*b* color system (after titration). These measured values were applied to the following formula (1) to calculate a color difference ΔE* before and after titration of the overcoat composition.

$$\Delta E^* = [(a2-a1)^2+(b2-b1)^2+(L2-L1)^2]^{1/2} \quad (1)$$

<Preparation of Printed Matter>

A color image forming apparatus equipped with the developers 1 for the respective colors (IMAGIO MP C7500, made by Ricoh Company Ltd.) was used to output a test chart No. 4 according to ISO/IEC 15775:1999 on POD gloss coated paper made by Oji Paper Co., Ltd. (basis weight: 128 g/m$^2$) as a recording medium under conditions that toner was adhered in a quantity of 0.4 mg/cm$^2$ on a solid image part of single color toner. Thereby, a printed matter was obtained.

<Measurement of Wax Coverage Factor>

Red, green and blue fixed solid images formed with at least two toners using a test chart No. 4 according to ISO/IEC 15775:1999 were cut out and exposed for 5 minutes to saturated vapor of 5% by mass of an aqueous ruthenium tetroxide solution (made by TABB Inc.), by which ruthenium tetroxide was chemically modified.

Then, the surface of an image on the chemically-modified printed matter was observed by using a transmission electron microscope/scanning electron microscope (ULTRA55 made by Carl Zeiss AG) with magnifications of 1,000 at an accelerating voltage of 0.8 kV to obtain a reflection electron SEM image.

Image processing was carried out in which Photoshop (made by Adobe Systems Inc.) was used to classify pixels comprising the obtained reflection electron SEM image into a black part and a white part (binarization), thereby obtaining a binarization image. Then, measurement was made for an area percentage of the black part with respect to an entire area of the binarization image (wax coverage factor). The results are shown in Table 2. The red, green and blue fixed solid images were measured to obtain the wax coverage factors of the respective colors, of which a maximum value is shown.

<Evaluation of Repelling Property (Wettability)>

A UV varnish coater (SG610V, made by Shinano Kenshi Co., Ltd.) was used to coat the overcoat composition 1 on the printing surface of the to-be-printed matter at a coater speed of 10 m/minute at radiation of 120 W/cm so as to give a thickness of 5 g/m$^2$ (4.5 μm). The photo-curing overcoat composition 1 was cured by using the UV varnish coater. After curing, the overcoat composition 1 on the printed matter was macroscopically checked for the extent of repelling and evaluated on the basis of the following criteria. The results are shown in Table 2. Where repelling is found on the overcoat composition, developed is a several-millimeter to several-centimeter region substantially devoid of the overcoat layer. This region reflects light unnaturally, which is found to be an unfavorable image just by sight.

[Criteria]

A: No repelling

B: Repelling is found very slightly but acceptable

C: Repelling is found to some extent but acceptable

D: Apparent repelling is found

<Evaluation of Attachment Property>

A UV varnish coater (SG610V, made by Shinano Kenshi Co., Ltd.) was used to coat the overcoat composition 1 on the printing surface of the to-be-printed matter so as to give a thickness of 5 g/m$^2$ (4.5 μm) and UV was radiated by using the UV varnish coater to cure the overcoat composition.

The overcoat layer on the printed matter after curing was cut by using an utility knife so as to give a board made up of 100 cells at 1 mm intervals according to JIS K5400. Then, an adhesive cellophane adhesive tape (CT-18, made by Nichiban Co., Ltd.) was attached on the surface of the printed matter and peeled off. And, the number of cells which were not peeled off was counted by using a magnifying glass and evaluation was made on the basis of the following criteria. The results are shown in Table 2.

[Criteria]

A: 100/100

B: 80/100 to 99/100

C: 40/100 to 79/100

D: 0/100 to 39/100

<State of Image>

An image after formation of the overcoat layer was checked macroscopically for the presence or absence of distortion with reference to the image before formation of the overcoat layer. The state of the image was evaluated on the basis of the following criteria.

[Criteria]

A: Image is free of distortion and favorable.

B: Image is slightly distorted.

C: Image is greatly distorted.

Example 2

<Preparation of Toners 2>

Black, yellow, magenta and cyan toners 2 were prepared in the same manner as in Example 1 except that the microcrystalline wax used in Example 1 was changed to a mixture of microcrystalline wax with paraffin wax (isoparaffin content: 9% by mass, weight-average molecular weight Mw: 520).

The thus obtained toners 2 for the respective colors were measured for average circularity and volume average particle diameter Dv in the same manner as in Example 1, and the circularity was 0.91 and volume average particle diameter Dv was 6.8 μm.

<Preparation of Developers 2>

A carrier prepared by coating a silicone resin on magnetite particles with a volume average particle diameter of 50 μm so as to give an average thickness of 0.5 μm was used to mix the toners 2 for the respective colors so as to give a toner concentration of 5.0% by mass, thereby preparing the developers 2 for the respective colors.

<Formulation of Overcoat Composition 2>

40 parts by mass of a polyester acrylate oligomer (EBECRYL846, weight-average molecular weight Mw: 1,100, made by Daicel Cytec Company Ltd.), 2.5 parts by mass of ethoxydiethylene glycol acrylate as a polymerizable unsaturated compound, 30 parts by mass of tripropylene glycol diacrylate as a polymerizable unsaturated compound, 50 parts by mass of acryloylmorpholine as a polymerizable unsaturated compound, 0.2 parts by mass of hydroquinone monomethyl ether as a polymerization prohibiting agent, 8 parts by mass of benzoin ethyl ether as a photo-polymerization initiator and 3 parts by mass of triisopropanol amine as a sensitizing agent were mixed and agitated at 60° C. for 20 minutes to prepare a photo-curing overcoat composition 2.

The thus obtained overcoat composition 2 was measured for viscosity at 25° C. in the same manner as in Example 1, and the viscosity was 460 mPa·s.

<Evaluation>

Evaluation was made in the same manner as in Example 1 except that the developers 1 and the overcoat composition 1 used in Example 1 were changed to the developers 2 and overcoat composition 2. The results are shown in Table 2.

Example 3

<Preparation of Toners 3>

Black, yellow, magenta and cyan toners 3 were prepared in the same manner as in Example 1 except that microcrystalline wax used in Example 1 was changed to a mixture of microcrystalline wax with paraffin wax (isoparaffin content: 4.1% by mass, weight-average molecular weight Mw: 550).

The thus obtained toners 3 for the respective colors were measured for average circularity and volume average particle diameter Dv in the same manner as in Example 1, and the average circularity was 0.91 and volume average particle diameter Dv was 7.9 μm.

<Preparation of Developers 3>

A carrier prepared by coating a silicone resin on magnetite particles with a volume average particle diameter of 50 μm so as to give an average thickness of 0.5 μm was used to mix the toners 3 for the respective colors so as to give a toner concentration of 5.0% by mass, thereby preparing the developers 3 for the respective colors.

<Evaluation>

Evaluation was made in the same manner as in Example 1 except that the developers 1 and the overcoat composition 1 used in Example 1 were changed to the developers 3 and overcoat composition 2. The results are shown in Table 2.

Example 4

<Preparation of Toners 4>

Black, yellow, magenta and cyan toners 4 were prepared in the same manner as in Example 1 except that the microcrystalline wax used so in Example 1 was changed to paraffin wax (weight-average molecular weight Mw: 500).

The thus obtained toners 4 for the respective colors were measured for average circularity and volume average particle diameter Dv in the same manner as in Example 1, and the average circularity was 0.89 and DV was 8.0 μm.

<Preparation of Developers 4>

A carrier prepared by coating a silicone resin on magnetite particles with a volume average particle diameter of 50 μm so as to give an average thickness of 0.5 μm was used to mix the toners 4 for the respective colors so as to give a toner concentration of 5.0% by mass, thereby preparing the developers 4 for the respective colors.

<Evaluation>

Evaluation was made in the same manner as in Example 1 except that the developers 1 and the overcoat composition 1 used in Example 1 were changed to the developers 4 and overcoat composition 2. The results are shown in Table 2.

Example 5

<Preparation of Toners 5>

Black, yellow, magenta and cyan toners 5 were prepared in the same manner as in Example 1 except that 5 parts by mass of the microcrystalline wax used in Example 1 was changed to 1.6 parts by mass of paraffin wax (weight-average molecular weight Mw: 500).

The thus obtained toners 5 for the respective colors were measured for average circularity and volume average particle diameter Dv in the same manner as in Example 1, and the average circularity was 0.90 and volume average particle diameter Dv was 7.8 μm.

<Preparation of Developers 5>

A carrier prepared by coating a silicone resin on magnetite particles with a volume average particle diameter of 50 μm so as to give an average thickness of 0.5 μm was used to mix the color toners 5 for the respective colors so as to give a toner concentration of 5.0% by mass, thereby preparing the developers 5 for the respective colors.

<Evaluation>

Evaluation was made in the same manner as in Example 1 except that the developers 1 and the overcoat composition 1 used in Example 1 were changed to the developers 5 and overcoat composition 2. The results are shown in Table 2.

Example 6

<Preparation of Toners 6>

Black, yellow, magenta and cyan toners 6 were prepared in the same manner as in Example 1 except that the microcrystalline wax used in Example 1 was changed to a mixture of microcrystalline wax with paraffin wax (isoparaffin content: 11.3% by mass, weight average so molecular weight Mw: 480).

The thus obtained toners 6 for the respective colors were measured for average circularity and volume average particle diameter Dv in the same manner as in Example 1, and the average circularity was 0.91 and volume average particle diameter Dv was 7.8 μm.

<Preparation of Developers 6>

A carrier prepared by coating a silicone resin on magnetite particles with a volume average particle diameter of 50 μm so as to give an average thickness of 0.5 μm was used to mix the toners 6 for the respective colors so as to give a toner concentration of 5.0% by mass, thereby preparing the developers 6 for the respective colors.

<Preparation of Overcoat Composition 3>

10 parts by mass of an urethane acrylate oligomer (EBECRYL5129, weight-average molecular weight Mw: 800, made by Daicel Cytec Company Ltd.), 41 parts by mass of 1,6-hexanediol diacrylate as a polymerizable unsaturated compound, 10 parts by mass of cyclohexyl acrylate as a polymerizable unsaturated compound, 80 parts by mass of ethylcarbitol acrylate as a polymerizable unsaturated compound, 2.5 parts by mass of ethoxydiethylene glycol acrylate as a polymerizable unsaturated compound, 0.3 parts by mass of hydroquinone monomethyl ether as a polymerization prohibiting agent and 6 parts by mass of benzyl (1,2-diphenyl ethanedione) as a photo-polymerization initiator were mixed and agitated at 60° C. for 20 minutes to obtain a photo-curing overcoat composition 3.

The thus obtained overcoat composition 3 was measured for viscosity at 25° C. in the same manner as in Example 1, and the viscosity was 20 mPa·s.

<Evaluation>

Evaluation was made in the same manner as in Example 1 except that the developers 1 and the overcoat composition 1 used in Example 1 were changed to the developers 6 and overcoat composition 3. The results are shown in Table 2.

Example 7

<Preparation of Overcoat Composition 4>

60 parts by mass of a polyester acrylate oligomer (EBECRYL1830, weight-average molecular weight Mw: 1,500, made by Daicel Cytec Company Ltd.), 30 parts by mass of bisphenol A ethylene oxide adduct diacrylate (V#700, made by Osaka Organic Chemical Industry Ltd.) as a polymerizable unsaturated compound, 5 parts by mass of 2-ethylhexyl acrylate as a polymerizable unsaturated compound, 20 parts by mass of 1,6-hexanediol diacrylate as a polymerizable unsaturated compound, 2.5 parts by mass of ethoxydiethylene glycol acrylate as a polymerizable unsaturated compound, 0.4 parts by mass of 2,6-ditert-butyl-p-cresol (BHT) as a polymerization prohibiting agent and 9 parts by mass of Irgacure 184 (made by Ciba Specialty Chemicals Inc.) as a photo-polymerization initiator were mixed and agitated at 60° C. for 20 minutes to obtain a photo-curing overcoat composition 4.

The thus obtained overcoat composition 4 was measured for viscosity at 25° C. in the same manner as in Example 1, and the viscosity was 740 mPa·s.

<Evaluation>

Evaluation was made in the same manner as in Example 1 except that the overcoat composition 1 used in Example 1 was changed to the overcoat composition 4. The results are shown in Table 2.

Example 8

<Preparation of Overcoat Composition 5>

9 parts by mass of pentaerythritol tetraacrylate as a polymerizable unsaturated compound, 2.5 parts by mass of ethoxydiethylene glycol acrylate as a polymerizable unsaturated compound, 30 parts by mass of trimethylolpropane triacrylate as a polymerizable unsaturated compound and 0.3 parts by mass of hydroquinone as a polymerization prohibiting agent were put into a beaker and heated up to 120° C. while agitating, and 50 parts by mass of a diallylphthalate prepolymer (Daiso Dap 100, made by Daiso Co., Ltd.) was also dissolved. Further, 2 parts by mass of aluminum isopropylate was dispersed in 2 parts by mass of toluene, a resultant thereof was gradually added and agitated at 110° C. for 20 minutes. During this time, toluene added as a solvent was removed from a system o obtain a photo-curing varnish base agent.

Next, 70 parts by mass of the photo-curing varnish base agent, 60 parts by mass of 1,6-hexanediol diacrylate as a polymerizable unsaturated compound, 10 parts by mass of benzophenone as a photo-polymerization initiator, 5 parts by mass of p-dimethylamino acetophenone, 10 parts by mass of phenylglycol monoacrylate as a viscosity adjusting agent, and 4.5 parts by mass of polyoxyethyleneglycol alkylether as a surfactant were mixed and well kneaded by using a three roll mill to obtain a photo-curing overcoat composition 5.

The thus obtained overcoat composition 5 was measured for viscosity at 25° C. in the same manner as in Example 1, and the viscosity was 180 mPa·s.

<Evaluation>

Evaluation was made in the same manner as n Example 1 except that the overcoat composition 1 used in Example 1 was changed to the overcoat composition 5. The results are shown in Table 2.

Example 9

<Preparation of Overcoat Composition 6>

60 parts by mass of a polyester acrylate oligomer (EBECRYL1830, weight-average molecular weight Mw: 1,500, made by Daicel Cytec Company Ltd.), 30 parts by mass of bisphenol A ethylene oxide adduct diacrylate (V#700, made by Osaka Organic Chemical Industry Ltd.) as a polymerizable unsaturated compound, 3 parts by mass of 2-ethylhexyl acrylate as a polymerizable unsaturated compound, 20 parts by mass of 1,6-hexanediol diacrylate as a polymerizable unsaturated compound, 2.5 parts by mass of ethoxydiethylene glycolacrylate as a polymerizable unsaturated compound, 0.4 parts by mass of 2,6-ditert-butyl-p-cresol (BHT) as a polymerization prohibiting agent, 9 parts by mass of Irgacure 184 (made by Ciba Specialty Chemicals Inc.) as a photo-polymerization initiator and 2 parts by mass of sodium dialkylsulfosuccinate as an anionic surfactant were mixed and agitated at 60° C. for 20 minutes to obtain a photo-curing overcoat composition 6.

The thus obtained overcoat composition 6 was measured for viscosity at 25° C. in the same manner as in Example 1, and the viscosity was 410 mPa·s.

<Evaluation>

Evaluation was made in the same manner as in Example 1 except that the overcoat composition 1 used in Example 1 was changed to the overcoat composition 6. The results are shown in Table 2.

Example 10

<Preparation of Toners 7)

-Synthesis of Unmodified Polyester (Low Molecular Weight Polyester)-

67 parts by mass of bisphenol A ethylene oxide 2-mole adduct, 84 so parts by mass of bisphenol A propion oxide 3-mole adduct, 274 parts by mass of terephthalic acid, and 2 parts by mass of dibutyltin oxide were placed into a reaction tank equipped with a cooling tube, an agitator and a nitrogen introducing tube and allowed to react under normal pressure at 230° C. for 8 hours.

Next, the thus obtained reaction solution was allowed to react for 6 hours under reduced pressure of 10 mmHg to 15 mmHg, thereby synthesizing an unmodified polyester.

The thus obtained unmodified polyester was 2,200 in number average molecular weight (Mn), 5,700 in weight-average molecular weight Mw and 56° C. in glass transition temperature Tg.

-Formulation of Master Batch (MB)-

1,000 parts by mass of water, 540 parts by mass of carbon black (Printex 35, made by Evonik Degussa Japan Ltd., DBP oil absorption=42 mL/100 g, pH=9.5) and 1,200 parts by mass of the unmodified polyester were mixed by using a Henschel mixer (made by Nippon Coke & Engineering Co., Ltd.).

After the thus obtained mixture was kneaded at 150° C. for 30 minutes by using a two-roll mill, the resultant was rolled and cooled, and then, pulverized by using a pulverizer (made by Hosokawa Micron Corporation) to prepare a master batch.

-Synthesis of Prepolymer- 682 parts by mass of bisphenol A ethyleneoxide 2-mole adduct, 81 parts by mass of bisphenol A propylene oxide 2-mole adduct, 283 parts by mass of terephthalic acid, 22 parts by mass of trimellitic anhydride, and 2 parts by mass of dibutyltin oxide were placed into a reaction vessel equipped with a cooling tube, an agitator and a nitrogen introducing tube and allowed to react under normal pressure at 230° C. for 8 hours.

Next, the thus obtained reaction solution was allowed to react for 5 hours under reduced pressure of 10 mmHg to 15 mmHg, thereby synthesizing an intermediate polyester.

The thus obtained intermediate polyester was 2,100 in number average molecular weight Mn, 9,600 in weight-average molecular weight Mw, 55° C. in glass transition temperature Tg, 0.5 mg KOH/g in acid value and 49 mg KOH/g in hydroxyl value.

Then, 411 parts by mass of the intermediate polyester, 89 parts by mass of isophorone diisocyanate and 500 parts by mass of ethyl acetate were placed into a reaction vessel equipped with a cooling tube, an agitator and a nitrogen introducing tube and allowed to react at 100° C. for 5 hours, thereby synthesizing a prepolymer (modified polyester capable of reacting with an active hydrogen group-containing compound).

The thus obtained prepolymer was 1.60% by mass in content of free isocyanate and the prepolymer was 50% by mass in solid-based concentration (after being allowed to stand at 150° C. for 45 minutes).

-Synthesis of Ketimine (Active Hydrogen Group-Containing Compound)-

30 parts by mass of isophorone diamine and 70 parts by mass of methylethyl ketone were placed into a reaction vessel at which a stirring rod and a thermometer were set, and allowed to react at 50° C. for 5 hours, thereby synthesizing a ketimine compound (active hydrogen group-containing compound).

The thus obtained ketimine compound (active hydrogen group-containing compound) was 423 in amine value.

-Synthesis of Styrene-Acryl Copolymer Resin- 300 parts by mass of ethyl acetate was placed into a reaction vessel equipped with a cooling tube, an agitator and a nitrogen introducing tube, then, 300 parts by mass of a styrene-acryl monomer mixture (styrene/acrylic acid 2-ethyhexyl/acrylic acid/acrylic acid 2-hydroxyl ethyl=75/15/5/5) and 10 parts by mass of azobisisobutyronitrile were fed thereinto, and a resultant thereof was allowed to react at 60° C. for 15 hours under normal pressure in nitrogen atmosphere.

Next, 200 parts by mass of methanol was added to the reaction solution and agitated for 1 hour. Then, the reaction solution from which a supernatant fluid was removed was dried under reduced pressure, thereby obtaining a styrene-acryl copolymer resin.

-Dissolution of Toner Material or Formulation of Dispersion Solution- 10 parts by mass of the prepolymer, 60 parts by mass of the unmodified polyester, 130 parts by mass of ethyl acetate and 30 parts by mass of the styrene-acryl copolymer were placed into a beaker and a resultant was agitated and dissolved.

Next, 10 parts by mass of microcrystalline wax (isoparaffin content: 14.5% by mass, weight-average molecular weight Mw: 650) and 10 parts by mass of the master batch were fed therein. A bead mill (Ultravisco Mill, made by Imex Co., Ltd.) was used to prepare a starting material solution under the following conditions: feeding speed, 1 kg/hour; circumferential speed of disk, 6 m/second; loading amount of zirconia beads with a particle diameter of 0.5 mm, 80% by volume; and pass schedule, 3 times. Then, 2.7 parts by mass of the ketimine was added thereto to dissolve the toner material and prepare the dispersion solution.

-Formulation of Aqueous Medium Phase- 306 parts by mass of ion exchanged water, 265 parts by mass of 10% by mass of tricalcium phosphate suspension and 0.2 parts by mass of sodium dodecylbenzene sulfonate were mixed and agitated to uniformly dissolve, thereby preparing an aqueous medium phase.

-Formulation of Emulsion or Dispersion Solution- 150 parts by mass of the aqueous medium phase was placed into a vessel and agitated at 12,000 rpm by using a TK-type homomixer (made by Primix Corporation). And, 100 parts by mass of a solution or dispersion solution of the toner material was added thereto, and a resultant thereof was mixed for 10 minutes to prepare an emulsion or dispersion solution (emulsified slurry).

-Removal of Organic Solvent- 100 parts by mass of the emulsified slurry was placed into a flask at which an agitator and a thermometer were set was subjected to a solvent removal process at 30° C. for 12 hours, while being agitated at agitation circumferential speed of 20 m/minute, thereby obtaining a dispersed slurry.

-Washing and Drying-

After 100 parts by mass of the dispersed slurry was filtered under reduced pressure, 100 parts by mass of ion exchanged water was added to a filter cake, a resultant thereof was mixed by using a TK-type homomixer (at 12,000 rpm and for 10 minutes) and, thereafter, filtered.

300 parts by mass of ion exchanged water was added to the thus obtained filter cake and a resultant thereof was mixed by using the TK-type homomixer (at 12,000 rpm and for 10 minutes) and thereafter filtered, the procedure of which was carried out twice.

20 parts by mass of 10% by mass of an aqueous sodium hydroxide solution was added to the thus obtained filter cake and a resultant thereof was mixed by using the TK-type homomixer (at 12,000 rpm and for 30 minutes) and thereafter filtered under reduced pressure.

300 parts by mass of ion exchanged water was added to the thus obtained filter cake, and a resultant thereof was mixed by using the TK-type homomixer (at 12,000 rpm and for 10 minutes) and thereafter filtered.

300 parts by mass of ion exchanged water was added to the thus obtained filter cake and a resultant thereof was mixed by using the TK-type homomixer (at 12,000 rpm and for 10 minutes) and thereafter filtered, the procedure of which was carried out twice.

Further, 20 parts by mass of 10% by mass of hydrochloric acid was added to the thus obtained filter cake, and a resultant thereof was mixed by using the TK-type homomixer (at 12,000 rpm and for 10 minutes) and thereafter filtered.

300 parts by mass of ion exchanged water was added to the thus obtained filter cake and a resultant thereof was mixed by using the TK-type homomixer (at 12,000 rpm and for 10 minutes) and thereafter filtered, the procedure of which was repeated twice. Thereby, a final filter cake was obtained.

The thus obtained final filter cake was dried at 45° C. for 48 hours by using an air circulation dryer and sieved through a mesh with 75 μm aperture to obtain toner starting particles.

-External Additive Treatment- 0.6 parts by mass of hydrophobic silica with an average particle diameter of 100 nm, 1.0 part by mass of titanium oxide with an average particle diameter of 20 nm and 0.8 parts by mass of hydrophobic silica fine particles with an average particle diameter of 15 nm were mixed with 100 parts by mass of the thus obtained toner starting particles by using a Henschel mixer to obtain black toner 7.

Yellow toner 7 was prepared in the same manner as in production of the black toner 7 except that C.I. Pigment Yellow 17 was used in place of the carbon black in producing the black toner 7.

Magenta toner 7 was prepared in the same manner as in production of the black toner 7 except that C.I. Pigment Red 57 was used in place of the carbon black in producing the black toner 7.

Cyan toner 7 was prepared in the same manner as in production of the black toner 7 except that C. I. Pigment Blue 15 was used in place of the carbon black in producing the black toner 7.

The thus obtained black, yellow, magenta and cyan toners 7 were measured for an average circularity and a volume average particle diameter Dv in the following manner, and the average circularity was 0.94 and volume average particle diameter Dv was 5.7 μm.

<Production of Developers 7>

-Production of Carrier- 21.0 parts by mass of an acryl resin solution (toluene solution of cyclohexylmethacrylate/methylmethacrylate=80/20 (mass ratio) copolymer prepared by synthesis of a monomer made by Mitsubishi Rayon Co., Ltd., solid content of 50% by mass), 6.4 parts by mass of a guanamine solution (Super Beckamine TD-126, made by DIC Corporation, dry solid content of 70% by mass), 7.6 parts by mass of alumina particles (Sumicorundom AA-03, made by Sumitomo Chemical Co., Ltd., average particle diameter of 0.3 μm, intrinsic resistance value $10^{14}$ (Ω·cm)), 65.0 parts by mass of a silicone resin solution (SR2410, made by Dow Corning Toray Co., Ltd., dry solid content of 23% by mass), 1.0 part by mass of aminosilane (SH6020, made by Dow Corning Toray Co., Ltd., dry solid content of 100% by mass), 60 parts by mass of toluene and 60 parts by mass of butyl cellosolve were dispersed for 10 minutes by using a homomixer, thereby obtaining a coated-film forming solution of alumina particles-containing acryl resin and silicone resin.

Burned ferrite power [$(MgO)_{1.8}(MnO)_{49.5}(Fe_2O_3)_{48.0}$: average particle diameter of 35 μm)] was used as a core material, and the coated-film forming solution was coated on the surface of the core material so as to give a thickness of 0.15 μm by using a spira coater (made by Okada Seiko Co., Ltd.) and dried. Thereafter, a produced substance was burned by being allowed to stand at 150° C. for 1 hour in an electric furnace. After cooling, the substance was disintegrated by using a sieve with an aperture of 106 μm to obtain a carrier with a weight average particle diameter of 35 μm.

7 parts by mass of the toners 7 for the respective colors was uniformly mixed with 100 parts by mass of the carrier by using a Turvla mixer in which a vessel thereof was moved rotationally to cause agitation, and a resultant thereof was electrically charged, thereby obtaining the developers 7 for the respective colors.

<Evaluation>

Evaluation was made in the same manner as in Example 1 except that the developers 1 used in Example 1 were changed to the developer 7. The results are shown in Table 2.

Example 11

Evaluation was made in the same manner as in Example 10 except that the image forming apparatus used in Example 10 (IMAGIO MP C7500, made by Ricoh Company Ltd.) was altered and the printing speed in the previously described <Preparation of printed matter> was decreased by 20% to print printed matter. The results are shown in Table 2.

Example 12

<Formulation of Overcoat Composition 7>

An overcoat composition 7 was prepared in the same manner as in formulation of the overcoat composition 3 except that 80 parts by mass of ethylcarbitol acrylate and 2.5 parts by mass of ethoxydiethylene glycol acrylate used in formulation of the overcoat composition 3 were changed to 25 parts by mass of ethyl carbitol acrylate, 40 parts by mass of ethoxydiethylene glycol acrylate and 15 parts by mass of trimethylolpropane triacrylate.

The thus obtained overcoat composition 7 was measured for viscosity at 25° C. in the same manner as in Example 1, and the viscosity was 80 mPa·s.

<Evaluation>

Evaluation was made in the same manner as in Example 1 except that the overcoat composition 1 used in Example 1 was changed to the overcoat composition 7. The results are shown in Table 2.

Example 13

<Formulation of Overcoat Composition 8>

An overcoat composition 8 was prepared in the same manner as in formulation of the overcoat composition 3 except that 80 parts by mass of ethyl carbitol acrylate and 2.5 parts by mass of ethoxydiethylene glycol acrylate used in formulating the overcoat composition 3 were changed to 50 parts by mass of ethylcarbitol acrylate, 20 parts by mass of ethoxydiethylene glycol acrylate and 10 parts by mass of trimethylolpropane triacrylate.

The thus obtained overcoat composition 8 was measured for viscosity at 25° C. in the same manner as in Example 1, and the viscosity was 40 mPa·s.

<Evaluation>

Evaluation was made in the same manner as in Example 1 except that the overcoat composition 1 used in Example 1 was changed to the overcoat composition 8. The results are shown in Table 2.

Comparative Example 1

<Formulation of Overcoat Composition 9>

9 parts by mass of pentaerythritol tetraacrylate as a polymerizable unsaturated compound, 2.5 parts by mass of ethoxydiethylene glycol acrylate as a polymerizable unsaturated compound, 30 parts by mass of trimethylolpropane triacrylate as a polymerizable unsaturated compound and 0.3 parts by mass of hydroquinone as a polymerization prohibiting agent were placed into a beaker and heated up to 120° C. while agitating, and 50 parts by mass of a diallylphthalate prepolymer (Daiso Dap 100, made by Daiso Co., Ltd.) was also dissolved therein. Further, 2 parts by mass of aluminum isopropylate was dispersed into 2 parts by mass of toluene, which was agitated at 110° C. for 20 minutes while being added gradually. In the meantime, the toluene added as a solvent was removed from a system to obtain a photo-curing varnish base agent.

Next, 75 parts by mass of the photo-curing varnish base agent, 60 parts by mass of 1,9-nonanediol diacrylate as a polymerizable unsaturated compound, 10 parts by mass of benzophenone as a photo-polymerization initiator, 5 parts by mass of p-dimethylamino acetophenone and 10 parts by mass of phenyl glycol monoacrylate as a viscosity adjusting agent were mixed and well kneaded by using a three-roll mill, thereby obtaining a photo-curing overcoat composition 9.

The thus obtained overcoat composition 9 was measured for viscosity in the following manner, which was 200 mPa·s.

<Evaluation>

Evaluation was made in the same manner as in Example 1 except that the overcoat composition 1 used in Example 1 was changed to the overcoat composition 9. The results are shown in Table 2.

Comparative Example 2

<Formulation of Overcoat Composition 10>

40 parts by mass of a polyester acrylate oligomer (EBECRYL846, weight-average molecular weight Mw: 1,100, made by Daicel Cytec Company Ltd.), 2.5 parts by mass of ethoxydiethylene glycol acrylate as a polymerizable unsaturated compound, 30 parts by mass of tripropylene glycol diacrylate as a polymerizable unsaturated compound, 50 parts by mass of 1,9-nonanediol diacrylate as a polymerizable unsaturated compound, 0.2 parts by mass of hydroquinone monomethyl ether as a polymerization prohibiting agent, 8 parts by mass of benzoinethyl ether as a photo-polymerization initiator and 3 parts by mass of triisopropanol amine as a sensitizing agent were mixed and agitated at 60° C. for 20 minutes, thereby obtaining a photo-curing overcoat composition 10.

The thus obtained overcoat composition 10 was measured for viscosity at 25° C. in the same manner as in Example 1, and the viscosity was 470 mPa·s.

<Evaluation>

Evaluation was made in the same manner as in Example 2 except that the overcoat composition 2 used in Example 2 was changed to the overcoat composition 10. The results are shown in Table 2.

Comparative Example 3

<Formulation of Overcoat Composition 11>

40 parts by mass of a polyester acrylate oligomer (EBECRYL846, weight-average molecular weight Mw: 1,100, made by Daicel Cytec Company Ltd.), 2.5 parts by mass of ethoxydiethylene glycol acrylate as a polymerizable unsaturated compound, 30 parts by mass of tripropylene glycol diacrylate as a polymerizable unsaturated compound, 300 parts by mass of acryloylmorpholine as a polymerizable unsaturated compound, 0.2 parts by mass of hydroquinone monomethyl ether as a polymerization prohibiting agent, 8 parts by mass of benzomethyl ether as a photo-polymerization initiator and 3 parts by mass of triisopropanol amine as a sensitizing agent were mixed and agitated at 60° C. for 20 minutes, thereby obtaining a photo-curing overcoat composition 11.

The thus obtained overcoat composition 11 was measured for viscosity at 25° C. in the same manner as in Example 1, and the viscosity was 15 mPa·s.

<Evaluation>

Evaluation was made in the same manner as in Example 2 except that the overcoat composition 2 used in Example 2 was changed to the overcoat composition 11. The results are shown in Table 2.

Comparative Example 4

<Formulation of Overcoat Composition 12>

60 parts by mass of a polyester acrylate oligomer (EBECRYL1830, weight-average molecular weight Mw: 1,500, made by Daicel Cytec Company Ltd.), 30 parts by mass of as bisphenol A ethylene oxide adduct diacrylate (V#700, made by Osaka Organic Chemical Industry Ltd.) as a polymerizable unsaturated compound, 5 parts by mass of 2-ethyhexyl acrylate as a polymerizable unsaturated compound, 200 parts by mass of 1,6-hexanediol diacrylate as a polymerizable unsaturated compound, 2.5 parts by mass of ethoxydiethylene glycol acrylate as a polymerizable unsaturated compound, 0.4 parts by mass of 2,6-ditert-butyl-p-cresol (BHT) as a polymerization prohibiting agent and 9 parts by mass of Irgacure 184 (made by Ciba Specialty Chemicals Inc.) as a photo-polymerization initiator were mixed and agitated at 60° C. for 20 minutes, thereby obtaining a photo-curing overcoat composition 12.

The thus obtained overcoat composition 12 was measured for viscosity at 25° C. in the same manner as in Example 1, and the viscosity was 200 mPa·s.

<Evaluation>

Evaluation was made in the same manner as in Example 1 except that the overcoat composition 1 used in Example 1 was changed to the overcoat composition 12. The results are shown in Table 2.

Comparative Example 5

<Formulation of Overcoat Composition 13>

10 parts by mass of pentaerythritol tetraacrylate, 30 parts by mass of trimethylol propane acrylate, 0.3 parts by mass of hydroquinone as a polymerization prohibiting agent were placed into a beaker and heated up to 120° C. while agitating, and 50 parts by mass of diallylphthalate prepolymer (Daiso Dap 100, made by Daiso Co., Ltd.) was dissolved therein. Further, 2 parts by mass of aluminum isopropylate was dispersed into 2 parts by mass of toluene, which was agitated at 110° C. for 20 minutes, while being added gradually. During this time, the toluene added as a solvent was removed from a system, thereby obtaining a photo-curing varnish base agent.

Next, 75 parts by mass of the photo-curing varnish base agent, 60 parts by mass of 1,9-nonanediol diacrylate, 10 parts by mass of benzophenone as a photo-polymerization initiator, 5 parts by mass of p-dimethylamino acetophenone and 10 parts by mass of phenylglycol monoacrylate as a viscosity adjusting agent were mixed and well kneaded by using a three-roll mill, thereby obtaining a photo-curing overcoat composition 13.

The thus obtained overcoat composition 13 was measured for viscosity at 25° C. in the same manner as in Example 1, and the viscosity was 240 mPa·s.

<Evaluation>

Evaluation was made in the same manner as in Example 4 except that the overcoat composition 2 used in Example 4 was changed to the overcoat composition 13, and an image forming apparatus (IMAGIO MP C7500, made by Ricoh Company Ltd.) was altered to decrease the printing speed previously described in <Preparation of printed matter> by 20% to print printed matter. The results are shown in Table 2.

Comparative Example 6

Evaluation was made in the same manner as in Comparative Example 5 except that the image forming apparatus (IMAGIO MP C7500, made by Ricoh Company Ltd.) used in Comparative Example 5 was altered to decrease the printing speed previously described in <<Preparation of printed matter> by 25%, and a single-color toner of a solid image part was given 0.5 mg/cm$^2$ in adhesion quantity, to print printed matter. The results are shown in Table 2.

TABLE 1-1

| | Toners (black, magenta, cyan, and yellow) | | | | |
|---|---|---|---|---|---|
| | | Waxes | | Volume average | Average |
| | No. | Type | Content (% by mass) | particle diameter Dv (μm) | circularity |
| Example 1 | 1 | Microcrystalline wax | 5.0 | 8.0 | 0.90 |
| Example 2 | 2 | Microcrystalline wax + Paraffin wax | 5.0 | 6.8 | 0.91 |
| Example 3 | 3 | Microcrystalline wax + Paraffin wax | 5.0 | 7.9 | 0.91 |
| Example 4 | 4 | Paraffin wax | 5.0 | 8.0 | 0.89 |
| Example 5 | 5 | Paraffin wax | 1.6 | 7.8 | 0.90 |
| Example 6 | 6 | Microcrystalline wax + Paraffin wax | 5.0 | 7.8 | 0.91 |
| Example 7 | 1 | Microcrystalline wax | 5.0 | 8.0 | 0.90 |
| Example 8 | 1 | Microcrystalline wax | 5.0 | 8.0 | 0.90 |
| Example 9 | 1 | Microcrystalline wax | 5.0 | 8.0 | 0.90 |
| Example 10 | 7 | Microcrystalline wax | 8.3 | 5.7 | 0.94 |
| Example 11 | 7 | Microcrystalline wax | 8.3 | 5.7 | 0.94 |
| Example 12 | 1 | Microcrystalline wax | 5.0 | 8.0 | 0,90 |
| Example 13 | 1 | Microcrystalline wax | 5.0 | 8.0 | 0.90 |
| Comparative Example 1 | 1 | Microcrystalline wax | 5.0 | 8.0 | 0.90 |
| Comparative Example 2 | 2 | Microcrystalline wax + Paraffin wax | 5.0 | 6.8 | 0.91 |
| Comparative Example 3 | 2 | Microcrystalline wax + Paraffin wax | 5.0 | 6.8 | 0.91 |
| Comparative Example 4 | 1 | Microcrystalline wax | 5.0 | 8.0 | 0.90 |
| Comparative Example 5 | 4 | Paraffin wax | 5.0 | 8.0 | 0.89 |
| Comparative Example 6 | 4 | Paraffin wax | 5.0 | 8.0 | 0.89 |

TABLE 1-2

| | Overcoat composition | | | | | | | | |
|---|---|---|---|---|---|---|---|---|---|
| | | | | Polymerizable unsaturated compound | | | | | |
| | No. | Viscosity (mPa · s) | Surfactant | Type | | | | | Content of A + B + C (% by mass) |
| Example 1 | 1 | 200 | Not used | A | D | E | K | — | 37.5 |
| Example 2 | 2 | 460 | Not used | B | F | K | — | — | 37.4 |
| Example 3 | 2 | 460 | Not used | B | F | K | — | — | 37.4 |
| Example 4 | 2 | 460 | Not used | B | F | K | — | — | 37.4 |
| Example 5 | 2 | 460 | Not used | B | F | K | — | — | 37.4 |
| Example 6 | 3 | 20 | Not used | A | G | C | K | — | 80.8 |
| Example 7 | 4 | 740 | Not used | A | H | I | K | — | 15.8 |
| Example 8 | 5 | 180 | Used | A | D | E | K | — | 37.6 |
| Example 9 | 6 | 410 | Used | A | H | I | K | — | 15.8 |
| Example 10 | 1 | 200 | Not used | A | D | E | K | — | 37.5 |

TABLE 1-2-continued

| | Overcoat composition | | | | | | | | |
|---|---|---|---|---|---|---|---|---|---|
| | | | | Polymerizable unsaturated compound | | | | | |
| | No. | Viscosity (mPa · s) | Surfactant | Type | | | | | Content of A + B + C (% by mass) |
| Example 11 | 1 | 200 | Not used | A | D | E | K | — | 37.5 |
| Example 12 | 7 | 80 | Not used | A | G | C | K | E | 44.8 |
| Example 13 | 8 | 40 | Not used | A | G | C | K | E | 61.8 |
| Comparative Example 1 | 9 | 200 | Not used | J | D | E | K | — | 0 |
| Comparative Example 2 | 10 | 470 | Not used | J | F | K | — | — | 0 |
| Comparative Example 3 | 11 | 15 | Not used | B | F | K | — | — | 78.2 |
| Comparative Example 4 | 12 | 200 | Not used | A | H | I | K | — | 65.2 |
| Comparative Example 5 | 13 | 240 | Not used | D | E | J | — | — | 0 |
| Comparative Example 6 | 13 | 240 | Not used | D | E | J | — | — | 0 |

Polymerizable unsaturated compounds
A: 1,6-hexanediol diacrylate
B: acryloylmorpholine
C: ethylcarbitol acrylate
D: pentaerythritol tetraacrylate
E: trimethylolpropane triacrylate
F: tripropylene glycol diacrylate
G: cyclohexyl acrylate
H: bisphenol A ethylene oxide adduct diacrylate
I: 2-ethylhexyl acrylate
J: 1,9-nonanediol diacrylate
K: ethoxydiethylene glycol acrylate

TABLE 2-1

| | Developer No. | Overcoat composition No. | Solid fixed image Wax coverage factor (%) | Fusion property Color difference ΔE* |
|---|---|---|---|---|
| Example 1 | 1 | 1 | 44 | 5.8 |
| Example 2 | 2 | 2 | 60 | 4.6 |
| Example 3 | 3 | 2 | 63 | 4.6 |
| Example 4 | 4 | 2 | 66 | 4.6 |
| Example 5 | 5 | 2 | 33 | 4.6 |
| Example 6 | 6 | 3 | 41 | 27.8 |
| Example 7 | 1 | 4 | 44 | 3.5 |
| Example 8 | 1 | 5 | 44 | 6.2 |
| Example 9 | 1 | 6 | 44 | 5.0 |
| Example 10 | 7 | 1 | 52 | 5.3 |
| Example 11 | 7 | 1 | 58 | 5.3 |
| Example 12 | 1 | 7 | 44 | 9.8 |
| Example 13 | 1 | 8 | 44 | 18.9 |
| Comparative Example 1 | 1 | 9 | 66 | 2.0 |
| Comparative Example 2 | 2 | 10 | 66 | 0.5 |
| Comparative Example 3 | 2 | 11 | 66 | 33.0 |
| Comparative Example 4 | 1 | 12 | 66 | 31.0 |
| Comparative Example 5 | 4 | 13 | 69 | 2.5 |
| Comparative Example 6 | 4 | 13 | 73 | 2.5 |

TABLE 2-2

| | Evaluation | | |
|---|---|---|---|
| | Repelling property (wettability) | Attachment property | State of image |
| Example 1 | A | A | A |
| Example 2 | A | A | A |
| Example 3 | A | A | A |
| Example 4 | B | B | A |
| Example 5 | A | A | A |
| Example 6 | A | A | B |
| Example 7 | A | B | A |
| Example 8 | A | A | A |
| Example 9 | A | B | A |
| Example 10 | A | A | A |
| Example 11 | A | A | A |
| Example 12 | A | A | A |
| Example 13 | A | B | A |
| Comparative Example 1 | B | D | B |
| Comparative Example 2 | B | D | B |
| Comparative Example 3 | B | A | C |
| Comparative Example 4 | B | A | C |
| Comparative Example 5 | C | D | A |
| Comparative Example 6 | D | D | A |

Aspects of the present invention are, for example, as follows.

<1> A color image forming method, including:

forming an electrostatic latent image on an electrostatic latent image bearing member;

developing the electrostatic latent image to form a visible image with at least two toners each containing a releasing agent and being selected from black toner, magenta toner, cyan toner and yellow toner;

transferring the visible image to a recording medium;

fixing the transferred image on the recording medium with a fixing member having no releasing agent on a surface thereof; and forming an overcoat layer on the fixed image, the overcoat layer being formed by polymerizing an overcoat composition, wherein when lightness L1, chromaticity a1 and chromaticity b1 according to an L*a*b* color system of the fixed image formed with the at least two toners as well as lightness L2, chromaticity a2 and chromaticity b2 according to the L*a*b* color system of the fixed image obtained after the overcoat composition is dropped at 0.4 mg/cm$^2$ from a height of 10 mm above the fixed image and the overcoat composition is removed after 10 seconds have passed are applied to the following formula (1), a color difference ΔE* is from 3.0 to 30.0:

$$\Delta E^*[(a2-a1)^2+(b2-b1)^2+(L2-L1)^2]^{1/2} \quad (1).$$

<2> The color image forming method according to <1>, wherein the color difference ΔE* is from 4.0 to 20.0.

<3> The color image forming method according to <2>, wherein the color difference ΔE* is from 4.0 to 10.0.

<4> The color image forming method according to <1> or <2>, wherein when at least any one of red, green and blue fixed solid images formed with the at least two toners using a test chart No. 4 according to ISO/IEC 15775:1999 is exposed to saturated vapor of an aqueous ruthenium tetroxide solution and is then radiated with electron beams at accelerating voltage of 0.8 kV to thereby obtain a reflection electron image and the reflection electron image is converted to a binarization image formed of a black part and a white part, an area percentage of the black part with respect to an entire area of the binarization image is from 40% to 70%.

<5> The color image forming method according to <4>, wherein the area percentage of the black part with respect to an entire area of the binarization image is from 42% to 65%.

<6> The color image forming method according to any one of <1> to <5>, wherein the overcoat composition contains at least one polymerizable unsaturated compound selected from 1,6-hexanediol diacrylate, ethyl carbitol acrylate and acryloylmorpholine, and the content of the polymerizable unsaturated compound is from 20% by mass to 60% by mass.

<7> The color image forming method according to any one of <1> to <6>, wherein the overcoat composition contains a surfactant.

<8> The color image forming method according to any one of <1> to <7>, wherein a viscosity of the overcoat composition is 30 mPa·s to 700 mPa·s at 25° C.

<9> The color image forming method according to any one of <1> to <8>, wherein the releasing agent contains microcrystalline wax.

<10> A color image forming apparatus, including:

an electrostatic latent image bearing member;

an electrostatic latent image forming unit which forms an electrostatic latent image on the electrostatic latent image bearing member;

a development unit which develops the electrostatic latent image to form a visible image with at least two toners each containing a releasing agent and being selected from black toner, magenta toner, cyan toner and yellow toner;

a transfer unit which transfers the visible image to a recording medium;

a fixing unit which fixes the transferred image on the recording medium with a fixing member having no releasing agent on a surface thereof, and an overcoat layer forming unit which forms an overcoat layer on the fixed image by polymerizing an overcoat composition, wherein when lightness L1, chromaticity a1 and chromaticity b1 according to an L*a*b* color system of the fixed image formed with the at least two toners as well as lightness L2, chromaticity a2 and chromaticity b2 according to the L*a*b* color system of the fixed image obtained after the overcoat composition is dropped at 0.4 mg/cm$^2$ from a height of 10 mm above the fixed image and the overcoat composition is removed after 10 seconds have passed are applied to the following formula (1), a color difference ΔE* is from 3.0 to 30.0:

$$\Delta E^*=[(a2-a1)^2+(b2-b1)^2+(L2-L1)^2]^{1/2} \quad (1).$$

<11> The color image forming apparatus according to <10>, wherein the color difference ΔE* is from 4.0 to 20.0.

<12> The color image forming apparatus according to <11>, wherein the color difference ΔE* is from 4.0 to 10.0.

<13> The color image forming apparatus according to <8>, wherein when at least any one of red, green and blue fixed solid images formed with the at least two toners using a test chart No. 4 according to ISO/IEC 15775:1999 is exposed to saturated vapor of an aqueous ruthenium tetroxide solution and is then radiated with electron beams at accelerating voltage of 0.8 kV to obtain a reflection electron image and the reflection electron image is converted to a binarization image formed of a black part and a white part, an area percentage of the black part with respect to an entire area of the binarization image is from 40% to 70%.

<14> The color image forming apparatus according to <13>, wherein the area percentage of the black part with respect to an entire area of the binarization image is from 42% to 65%.

This application claims priority to Japanese application No. 2012-161735, filed on Jul. 20, 2012, and incorporated herein by reference.

What is claimed is:

1. A color image forming method, comprising:

forming an electrostatic latent image on an electrostatic latent image bearing member;

developing the electrostatic latent image to form a visible image with at least two toners each containing a releasing agent and being selected from black toner, magenta toner, cyan toner and yellow toner;

transferring the visible image to a recording medium;

fixing the transferred image on the recording medium with a fixing member having no releasing agent on a surface thereof; and forming an overcoat layer on the fixed image, the overcoat layer being formed by polymerizing an overcoat composition, wherein when lightness L1, chromaticity a1 and chromaticity b1 according to an L*a*b* color system of the fixed image formed with the at least two toners as well as lightness L2, chromaticity a2 and chromaticity b2 according to the L*a*b* color system of the fixed image obtained after the overcoat composition is dropped at 0.4 mg/cm$^2$ from a height of 10 mm above the fixed image and the overcoat composition is removed after 10 seconds have passed are applied to the following formula (1), a color difference ΔE* is from 3.0 to 30.0:

$$\Delta E^*=[(a2-a1)^2+(b2-b1)^2+(L2-L1)^2]^{1/2} \quad (1), \text{ and}$$

wherein when at least any one of red, green and blue fixed solid images formed with the at least two toners using a test chart No. 4 according to ISO/IEC 15775:1999 is exposed to saturated vapor of an aqueous ruthenium tetroxide solution and is then radiated with electron beams at accelerating voltage of 0.8 kV to thereby obtain a reflection electron image and the reflection electron image is converted to a binarization image formed of a black part and a white part, an area percentage of the black part with respect to an entire area of the binarization image is from 40% to 70%.

2. The color image forming method according to claim 1, wherein the color difference ΔE* is from 4.0 to 20.0.

3. The color image forming method according to claim 1, wherein the color difference ΔE* is from 4.0 to 10.0.

4. The color image forming method according to claim 1, wherein the area percentage of the black part with respect to an entire area of the binarization image is from 42% to 65%.

5. The color image forming method according to claim 1, wherein the overcoat composition contains at least one polymerizable unsaturated compound selected from 1,6-hexanediol diacrylate, ethyl carbitol acrylate and acryloylmorpholine, and the content of the polymerizable unsaturated compound is from 20% by mass to 60% by mass.

6. The color image forming method according to claim 1, wherein the overcoat composition contains a surfactant.

7. The color image forming method according to claim 1, wherein a viscosity of the overcoat composition is 30 mPa·s to 700 mPa ·s at 25° C.

8. The color image forming method according to claim 1, wherein the releasing agent contains microcrystalline wax.

* * * * *